US007523787B2

(12) United States Patent
Richards et al.

(10) Patent No.: US 7,523,787 B2
(45) Date of Patent: Apr. 28, 2009

(54) REVERSE OUT VALVE FOR WELL TREATMENT OPERATIONS

(75) Inventors: William Mark Richards, Frisco, TX (US); Andrew Penno, Rio de Janeiro (BR)

(73) Assignee: Halliburton Energy Services, Inc., Houston, TX (US)

( * ) Notice: Subject to any disclaimer, the term of this patent is extended or adjusted under 35 U.S.C. 154(b) by 445 days.

(21) Appl. No.: 11/282,514

(22) Filed: Nov. 18, 2005

(65) Prior Publication Data

US 2007/0114043 A1 May 24, 2007

(51) Int. Cl.
*E21B 34/12* (2006.01)

(52) U.S. Cl. ..... 166/334.1; 166/386; 137/625.29

(58) Field of Classification Search ..... 137/625.29; 166/278, 386, 320, 332.1, 334.1, 334.4
See application file for complete search history.

(56) References Cited

U.S. PATENT DOCUMENTS

| | | | | |
|---|---|---|---|---|
| 3,054,415 | A * | 9/1962 | Baker et al. | 137/68.16 |
| 5,609,204 | A * | 3/1997 | Rebardi et al. | 166/51 |
| 5,871,050 | A | 2/1999 | Dobson et al. | |
| 6,148,915 | A * | 11/2000 | Mullen et al. | 166/278 |
| 7,011,157 | B2 * | 3/2006 | Costley et al. | 166/311 |
| 7,090,020 | B2 * | 8/2006 | Hill et al. | 166/373 |
| 7,128,151 | B2 | 10/2006 | Corbett | |
| 2007/0114043 | A1 * | 5/2007 | Richards et al. | 166/386 |

FOREIGN PATENT DOCUMENTS

| | | |
|---|---|---|
| EP | 0 950 794 A3 | 10/2001 |
| GB | 2 387 401 A | 10/2003 |

OTHER PUBLICATIONS

"Multi-Position Set-Down Service Tool"; BJ Services Company; Oct. 9, 2002; 1 page.
EPO Search Report with Letter; Jan. 31, 2007; 3 pages.

* cited by examiner

*Primary Examiner*—David J. Bagnell
*Assistant Examiner*—Daniel P Stephenson
(74) *Attorney, Agent, or Firm*—Lawrence R. Youst

(57) ABSTRACT

A reverse out valve (100) comprises an outer housing (120) and a mandrel (144) that form a bypass region (130) therebetween. The mandrel (144) includes a central flow path (164) with a valve seat (152) positioned therein and first and second side wall ports (148, 150). A valve element (168) is positioned in the central flow path (164). The valve element (168) and the valve seat (152) having a one way valve configuration that prevents downhole fluid flow and allows uphole fluid flow. The mandrel (144) is axially movable relative to the outer housing (120) between first and second positions. In the first position, a bypass passageway (184) is formed between the first and second side wall ports (148, 150) via the bypass region (130) thereby allowing bypass flow around the valve element (168) and the valve seat (152). In the second position, bypass flow is prevented.

32 Claims, 22 Drawing Sheets

REVERSE OUT VALVE FOR WELL TREATMENT OPERATIONS

TECHNICAL FIELD OF THE INVENTION

This invention relates, in general, to reversing out slurry from a work string following a well treatment operation and, in particular, to a reverse out valve that minimizes swabbing of the formation caused by service tool manipulations during the well treatment operation.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a completion string including a packer, a circulation valve, a fluid loss control device and one or more sand control screens is lowered into the wellbore to a position proximate the desired production interval. A service tool is then positioned within the completion string and a fluid slurry including a liquid carrier and a particulate material known as gravel is then pumped through the circulation valve into the well annulus formed between the sand control screens and the perforated well casing or open hole production zone.

The liquid carrier either flows into the formation or returns to the surface by flowing through the sand control screens or both. In either case, the gravel is deposited around the sand control screens to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

During such a gravel packing operation, the service tool used to deliver the gravel slurry must be operated between various positions. For example, the service tool typically has a run-in configuration, a gravel slurry pumping configuration and a reverse out configuration. In order to operate the service tool between these positions, the service tool is typically moved axially relative to the completion string. In addition, the service tool is typically used to open and close the circulation valve, which also requires the axially movement of the service tool relative to the completion string.

It has been found, however, that such axially movement of the service tool relative to the completion string can adversely affect the formation. Specifically, movement of the service tool uphole relative to the completion string can undesirably draw production fluids out of the formation. Likewise, movement of the service tool downhole relative to the completion string can undesirably force wellbore fluids into the formation. This type of swabbing can damage the formation including, for example, damaging the filter cake in an open hole completion. Therefore a need has arisen for a service tool that is able to be operated between its various positions without swabbing the formation.

SUMMARY OF THE INVENTION

The present invention disclosed herein comprises a reverse out valve for use within a service tool during a well treatment operation such as a gravel packing operation. The reverse out valve of the present invention allows for taking returns during the gravel packing operation and allows for reversing out the gravel from the work string following the gravel packing operation while substantially isolating the formation from the reverse out fluids. Importantly, the reverse out valve of the present invention allows for operation of the service tool between its various positions without swabbing the formation.

In one aspect, the present invention is directed to a reverse out valve that comprises an outer housing and a mandrel that is slidably disposed within the outer housing forming a bypass region therebetween. The mandrel includes a central flow path with a valve seat positioned therein and first and second side wall ports positioned on opposite sides of the valve seat. A valve element is positioned in the central flow path. The valve element and the valve seat have a one way valve configuration wherein fluid flow in a first direction relative to the central flow path is substantially prevented. The valve element is axially moveable relative to the valve seat to allow fluid flow in a second direction which is opposite of the first direction. The mandrel is axially movable relative to the outer housing between first and second positions. In the first position, a bypass passageway is formed between the first and second side wall ports via the bypass region thereby allowing bypass flow around the valve element and the valve seat. In the second position, bypass flow is prevented.

In another aspect, the present invention is directed to a method of operating a reverse out valve to minimize swabbing of a formation. The method includes providing at least two independent flow paths for fluid flow in a first direction and at least two independent flow paths for fluid flow in a second direction through a reverse out valve in a run in configuration of the reverse out valve, providing at least two independent flow paths for fluid flow in the first direction and at least three independent flow paths for fluid flow in the second direction through the reverse out valve in a circulating configuration of the reverse out valve and providing at least one flow path for fluid flow in the second direction through the reverse out valve in a reverse configuration of the reverse out valve.

In a further aspect, the present invention is directed to a method of operating a reverse out valve to minimize swabbing of a formation. The method includes running a reverse out valve downhole in a run in configuration while providing at least two independent flow paths for fluid flow in an uphole direction through the reverse out valve, pumping a first fluid into an annulus around the reverse out valve with the reverse out valve in a circulating configuration while providing at least three independent flow paths for taking returns in the uphole direction through the reverse out valve, retrieving the reverse out valve partially uphole while providing at least two independent flow paths for fluid flow in a downhole direction through the reverse out valve in the circulating configuration, retrieving the reverse out valve farther uphole to operate the reverse out valve from the circulating configuration to a reverse configuration and pumping a second fluid into the annulus around the reverse out valve while providing no more than one flow path for fluid flow in the downhole direction through the reverse out valve.

In yet another aspect, the present invention is directed to a reverse out valve that includes an outer housing and a mandrel that is slidably disposed within the outer housing forming a bypass region therebetween. The mandrel has a central flow path with a valve seat positioned therein and first and second side wall ports positioned on opposite sides of the valve seat. A valve element is positioned in the central flow path and operably associated with the valve seat to control fluid flow therebetween. The valve element has a fluid passageway. A flow tube is positioned in the central flow path and is in fluid communication with the fluid passageway of the valve element. The first and second side wall ports and the bypass region form a first fluid path through the reverse out valve. The valve element and the valve seat form a second fluid path through the reverse out valve. The flow tube and the fluid passageway form a third fluid path through the reverse out valve. The first, second and third fluid paths are independent of one another.

In an additional aspect, the present invention is directed to a reverse out valve that includes an outer housing and a mandrel that is slidably disposed within the outer housing forming a bypass region therebetween. The mandrel has a central flow path with a fluid flow control element positioned therein and first and second side wall ports positioned on opposite sides of the fluid flow control element. The mandrel is axially movable relative to the outer housing between first and second positions. In the first position, a bypass passageway is formed between the first and second side wall ports via the bypass region thereby allowing bypass flow around the fluid flow control element. In the second position, bypass flow is prevented. An axial force generator is positioned between the outer housing and the mandrel to urge the mandrel toward the first position when the mandrel is in the second position. An axial lock prevents relative axial movement of the outer housing and the mandrel when the mandrel is in the second position and the axial lock is engaged.

In another aspect, the present invention is directed to a reverse out valve that includes an outer housing and a mandrel that is slidably disposed within the outer housing. The mandrel and the outer housing have a circulating configuration and a reverse configuration relative to one another. In the circulating configuration, the reverse out valve has two independent flow paths for fluid flow in a first direction and three independent flow paths for fluid flow in a second direction. In the reverse configuration, the reverse out valve has one flow path for fluid flow in the first direction and two independent flow paths for fluid flow in the second direction.

In a further aspect, the present invention is directed to a reverse out valve that includes an outer housing and a mandrel that is slidably disposed within the outer housing. The mandrel and the outer housing have a circulating configuration and a reverse configuration relative to one another. In the circulating configuration, the reverse out valve has at least two independent fluid flow paths for fluid flow in a first direction and three independent flow paths for fluid flow in a second direction. In the reverse configuration, the reverse out valve has no flow paths for fluid flow in the first direction and one flow path for fluid flow in the second direction.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
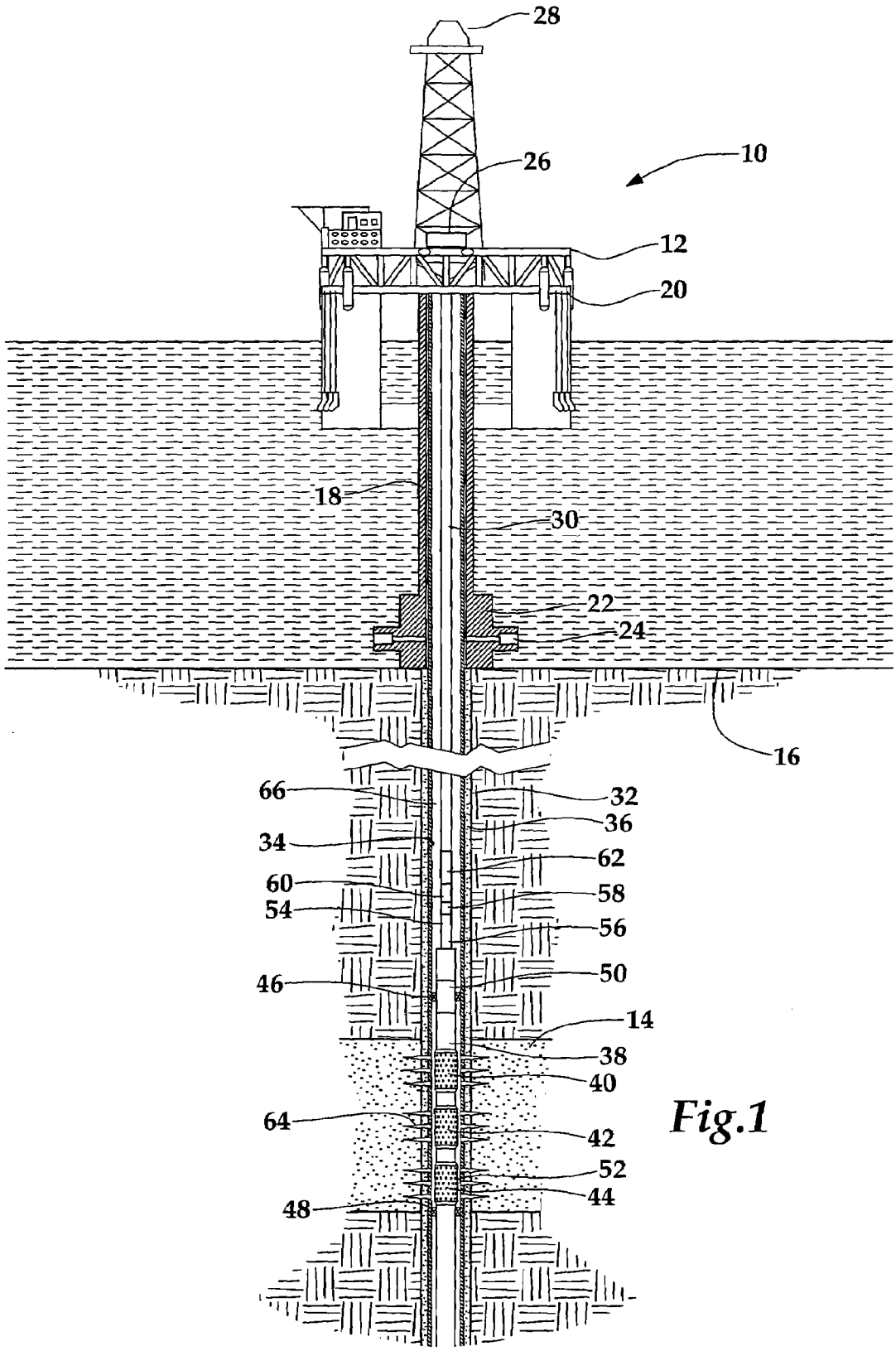
FIG. 1 is a schematic illustration of an offshore oil and gas platform operating a reverse out valve of the present invention during a gravel packing operation.

Referring initially to FIG. 1, a service tool including a reverse out valve of the present invention is being lowered into a completion string from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. A completion string 38 has been installed within casing 34. Completion string 38 includes sand control screens 40, 42, 44 positioned adjacent to formation 14 between packers 46, 48. Packer 46 is part of a circulating valve 50. When it is desired to gravel pack the annular region 52 around sand control screens 40, 42, 44, work string 30 is lowered through casing 34 and at least partially into completion string 38. Work string 30 includes a service tool 54 having a wash pipe 56, a reverse out valve 58, a cross over tool 60, a setting tool 62 and other tools that are known to those skilled in the art. Once service tool 54 is positioned within completion string 38, service tool 54 may be operated through its various positions to assure proper operation of service tool 54 and so that work string 30 may be pickled.

Thereafter, a fluid slurry including a liquid carrier and a particulate material such as sand, gravel or proppants is pumped down work string 30.

During this process, the fluid slurry exits service tool 54 into annular region 52 around sand control screens 40, 42, 44 via cross over tool 60 and circulating valve 50. As the fluid slurry travels within annular region 52, at least a portion of the gravel in the fluid slurry is deposited therein. Some of the liquid carrier may enter formation 14 through perforation 64 while the remainder of the fluid carrier enters sand control screens 40, 42, 44. This portion of the fluid carrier then enters wash pipe 56 passing through reverse out valve 58 and cross over tool 60 for return to the surface via annulus 66 above packer 46. The fluid slurry is pumped down work string 30 until annular region 52 around sand control screens 40, 42, 44 is filled with gravel.

Following this portion of the gravel packing operation, service tool 54 may be manipulated to, for example, prevent the taking of returns by closing reverse out valve 58. In this example, addition fluid slurry or other treatment fluid may now be pumped down work string 30, through cross over tool 60 and circulating valve 50 into annular region 52 to fracture formation 14. It may now be desirable to again manipulate service tool 54 to allow the taking of returns by opening reverse out valve 58. In this example, additional fluid slurry may now be pumped down work string 30, through cross over tool 60 and circulating valve 50 into annular region 52 to complete the gravel pack of annular region 52 around sand control screens 40, 42, 44. Following this portion of the gravel packing operation, service tool 54 may be manipulated to close reverse out valve 58 and may be used to close a sliding sleeve within circulating valve 50. In this configuration, fluid may be pumped down annulus 66 and into work string 30 through cross over tool 60 to reverse out the gravel within work string 30. Following the reverse out process, other well treatment operations may be performed as desired using service tool 54.

Even though FIG. 1 depicts a vertical well, it should be noted by one skilled in the art that the reverse out valve of the present invention is equally well-suited for use in deviated wells, inclined wells or horizontal wells. Also, even though FIG. 1 depicts an offshore operation, it should be noted by one skilled in the art that the reverse out valve of the present invention is equally well-suited for use in onshore operations. Further, even though FIG. 1 depicts a cased wellbore, it should be noted by one skilled in the art that the reverse out valve of the present invention is equally well-suited for use in open hole completions. Additionally, even though FIG. 1 has been described with reference to a gravel packing operation including a squeeze operation, it should be noted by one skilled in the art that the reverse out valve of the present invention is equally well-suited for use in a variety of treatment operations wherein it is desirable to selectively allow and prevent circulation of fluids through a service tool and prevent swabbing of the formation due to axial movement of the service tool.

Figure 2A:
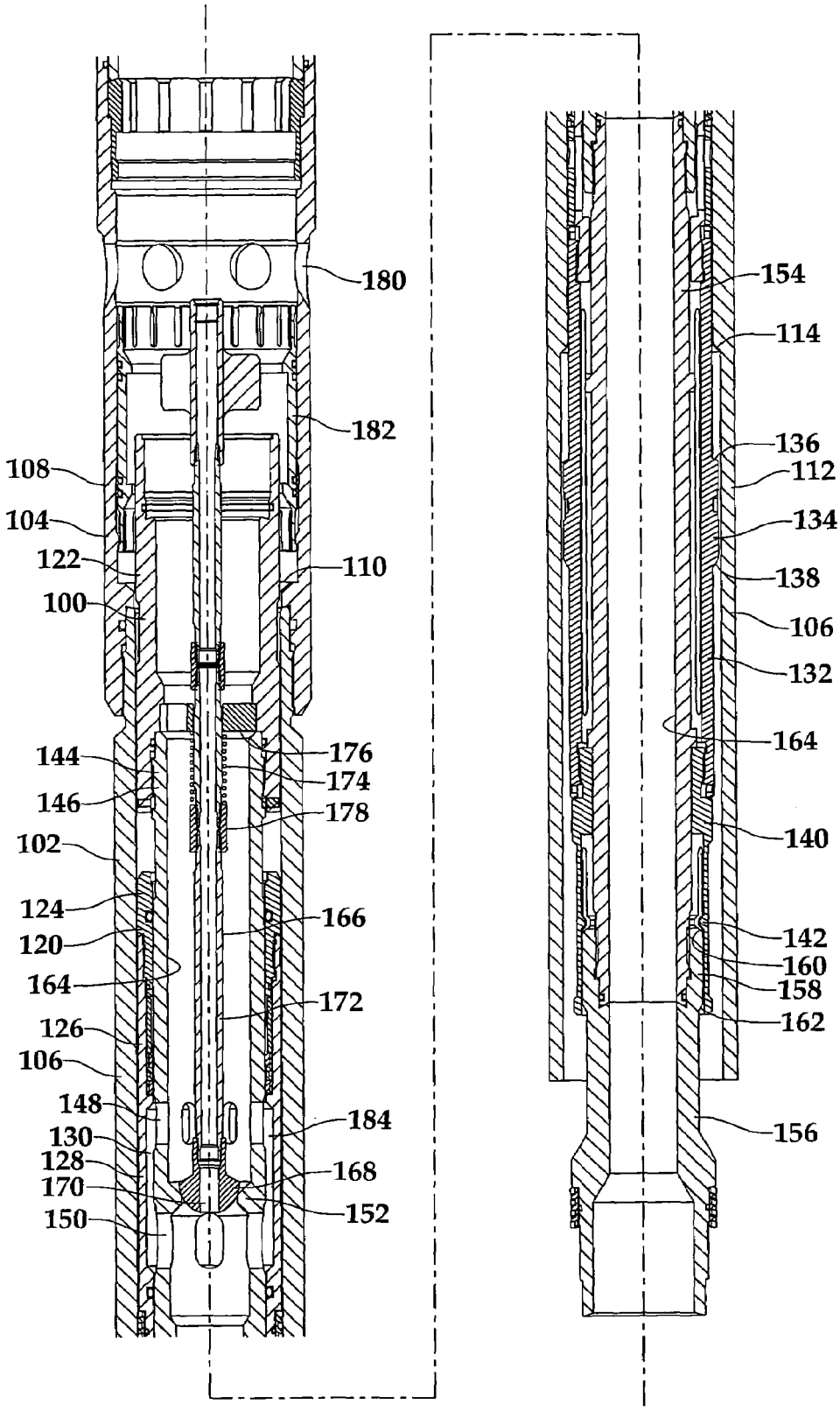
FIGS. 2A-2G are cross sectional views of successive axial sections of a reverse out valve of the present invention in its various positions as it is axially moved relative to a portion of a completion string.

Referring next to FIGS. 2A-2G, therein are depicted successive axial sections of a reverse out valve of the present invention in its various positions as it is axially moved relative to a portion of a completion string. Referring first to FIG. 2A, a reverse out valve 100 positioned within a section of a completion string 102 is in its circulating position. Completion string 102 includes a plurality of axially extending, substantially tubular members that are threadedly and sealingly coupled together. In the depicted portion of completion string 102 in FIG. 2A, circulation member 104 and hone bore member 106 are threadedly and sealingly coupled together. Circulation member 104 has a radially expanded internal section 108 and a shoulder 110. Hone bore member 106 has a radially expanded internal section 112 and a shoulder 114.

Reverse out valve 100 includes an axially extending, generally tubular outer housing 120. Outer housing 120 includes a substantially tubular upper connector 122 adapted to threadedly receive the pin end of another tubular member of the service tool such as a cross over tool. Outer housing 120 also includes a substantially tubular upper adaptor 124 that is threadedly and sealingly coupled to the upper end of an axially extending, generally tubular bypass housing member 126. Bypass housing member 126 has a radially expanded internal portion 128 that defines the exterior of a bypass region 130. Bypass housing member 126 is threadedly and sealingly coupled to the upper end of an axially extending, generally tubular indicating collet 132. Indicating collet 132 has one or more radially expanded outer regions 134 each including an upper shoulder 136 and a lower shoulder 138. Indicating collet 132 is threadedly and sealingly coupled to the upper end of an axially extending, generally tubular positioning collet 140. Positioning collet 140 includes one or more radially inwardly projecting members 142.

Reverse out valve 100 also includes an axially extending, generally tubular mandrel 144. Mandrel 144 includes an axially extending, generally tubular upper connector 146 that is threadedly and sealingly coupled to the lower end of upper connector 122 of outer housing 120. Upper connector 146 includes a first series of side wall ports 148 and a second series of side wall ports 150. In the illustrated embodiment, upper connector 146 has six side wall ports 148, only four of which are visible, and four side wall ports 150, only three of which are visible. It should be noted by those skilled in the art that other numbers of side wall ports 148, 150, both greater and less than six and four, are also possible and within the scope of the present invention. Upper connector 146 includes a valve seat 152 that is positioned in the axial section of upper connector 146 between side wall ports 148 and side wall ports 150. In the illustrated embodiment, valve seat 152 is integral with upper connector 146, however, valve seat 152 could alternatively be coupled with upper connector 146 by threading or using other connection techniques known to those skilled in the art. Mandrel 144 also includes an axially extending, generally tubular intermediate member 154 that is threadedly and sealingly coupled to the lower end of upper connector 146. Coupled to the lower end of intermediate member 154 is an axially extending, generally tubular lower connector 156 that is adapted to be threadedly received in the box end of another tubular member of the service tool. Lower connector 156 has a radially expanded outer portion 158 that includes an upper shoulder 160 and a lower shoulder 162. Mandrel 144 defines a central flow path 164.

Reverse out valve 100 further includes an axially extending, generally tubular valve element assembly 166 that is positioned within central flow path 164 of mandrel 144. Valve element assembly 166 includes a valve element 168 that is sealingly engageable with valve seat 152 of mandrel 144. Valve element 168 includes a fluid passageway 170. Valve element assembly 166 also includes a flow tube 172, the interior of which is in fluid communication with fluid passageway 170. A metallic force generator such as a spiral wound compression spring 174 is positioned around flow tube 172 and between a spring support member 176 of upper connector 122 and a spring support member 178 of flow tube 172.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that the reverse out valve of the present invention is not limited to such orientation as it is equally-well suited for use in inclined and horizontal orientations.

The operation of reverse out valve 100 will now be described with referring to FIGS. 2A-2G. In FIG. 2A, reverse out valve 100 is in its circulating position. Additionally, the circulating valve of completion string 102 is in its circulating position wherein circulation ports 180 of circulation member 104 are open to flow as sleeve 182 is in its lower position. In the circulating position of reverse out valve 100, a bypass passageway 184 is formed as side wall ports 150 and side wall ports 148 are in fluid communication via bypass region 130. In this configuration, there are up to three independent fluid paths through reverse out valve 100. Specifically, if reverse out valve 100 were moved downwardly relative to completion string 102, fluid could travel through bypass passageway 184, through central flow path 164 by moving valve element 168 off valve seat 152 and through flow tube 172 via fluid passageway 170. In addition, if reverse out valve 100 were moved upwardly relative to completion string 102, fluid could travel through bypass passageway 184 and through flow tube 172 then fluid passageway 170 but not through central flow path 164 as valve element 168 will be seated on valve seat 152. In this manner, movement of reverse out valve 100 in its circulating position either upwardly or downwardly relative to completion string 102 will not cause swabbing of the formation.

Figure 2B:
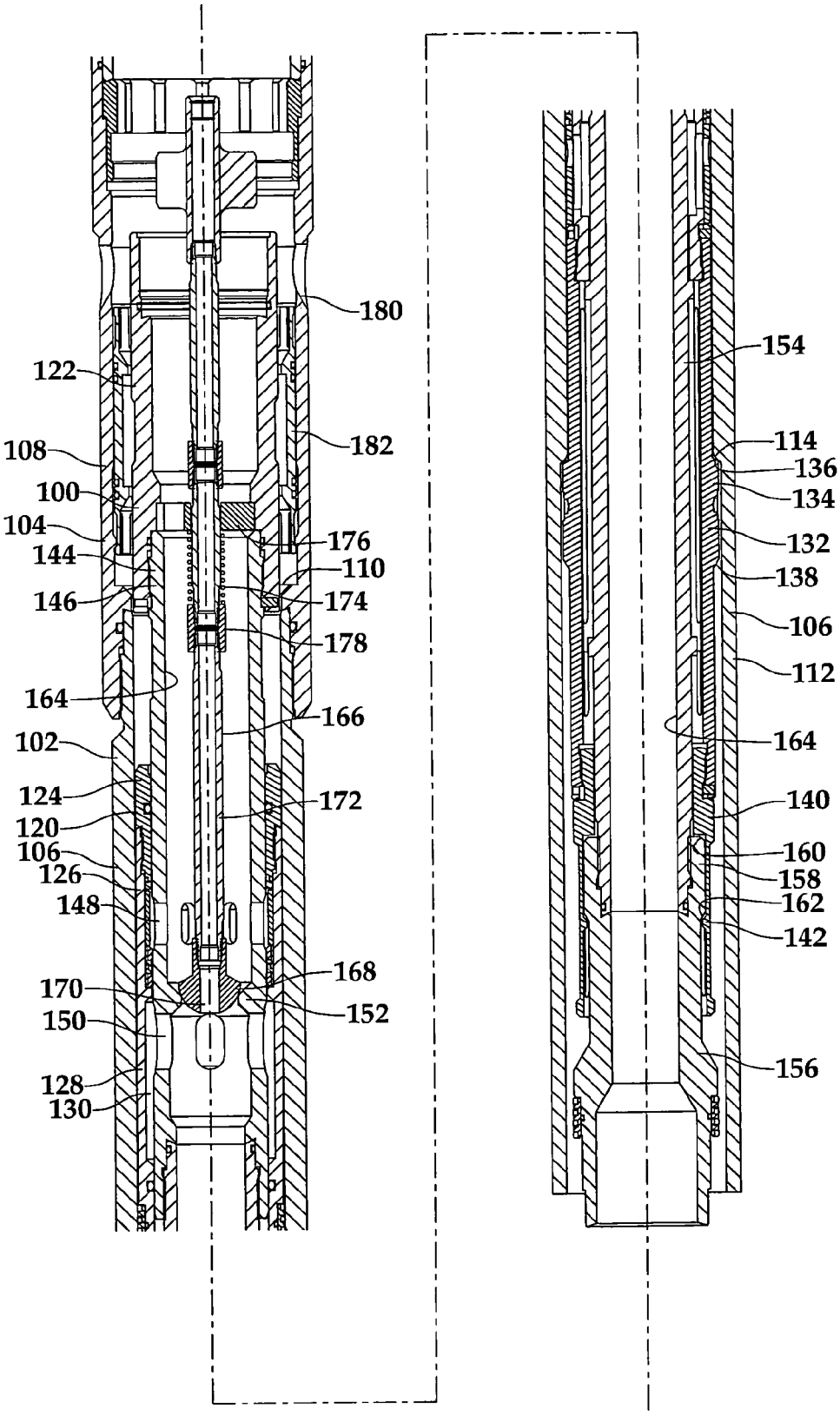

In FIG. 2B, reverse out valve 100 has been shifted from its circulating position to its reverse position. Additionally, the circulating valve of completion string 102 remains in its circulating position wherein circulation ports 180 of circulation member 104 are open to flow as sleeve 182 is in its lower position. Reverse out valve 100 has been shifted to its reverse position by moving reverse out valve 100 upwardly relative to completion string 102. As illustrated, shoulder 136 of indicating collet 132 is in contact with shoulder 114 of hone bore member 106. As sufficient downward force is applied against shoulder 136 of indicating collet 132 by shoulder 114 of hone bore member 106, the radially inwardly projecting members 142 of positioning collet 140 are outwardly urged over shoulder 160 of lower connector 156. As radially inwardly projecting members 142 slide downwardly over radially expanded outer portion 158 of lower connector 156, bypass passageway 184 is disable as side wall ports 150 and side wall ports 148 are in no longer in fluid communication via bypass region 130. In this configuration, there are up to two independent fluid paths through reverse out valve 100. Specifically, if reverse out valve 100 were moved downwardly relative to completion string 102, fluid could travel through central flow path 164 by moving valve element 168 off valve seat 152 and through flow tube 172 via fluid passageway 170. In addition, if reverse out valve 100 were moved upwardly relative to completion string 102, fluid could travel through flow tube 172 then fluid passageway 170. In this manner, movement of reverse out valve 100 in its reverse position either upwardly or downwardly relative to completion string 102 will not cause swabbing of the formation.

Figure 2C:
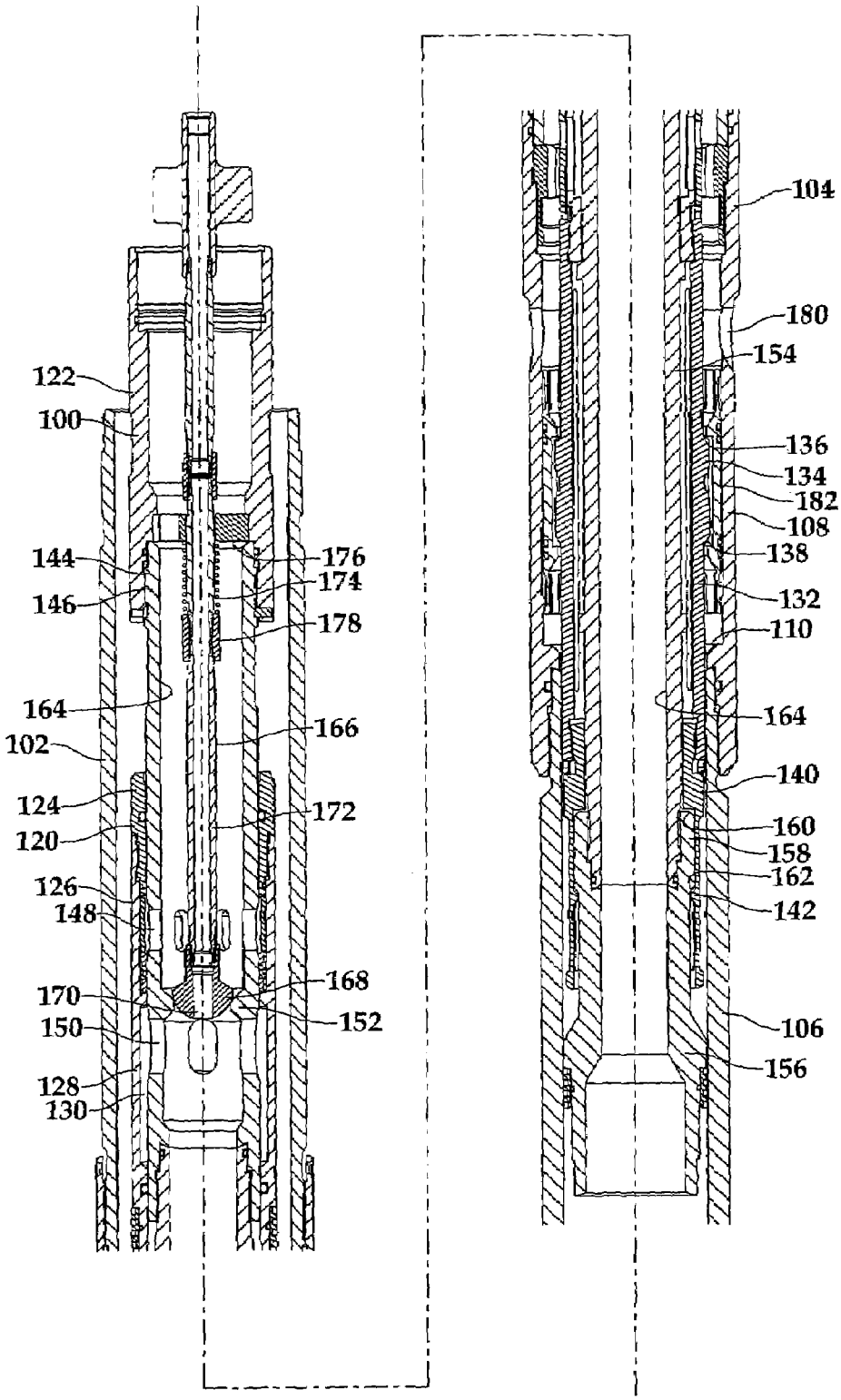
Figure 2D:
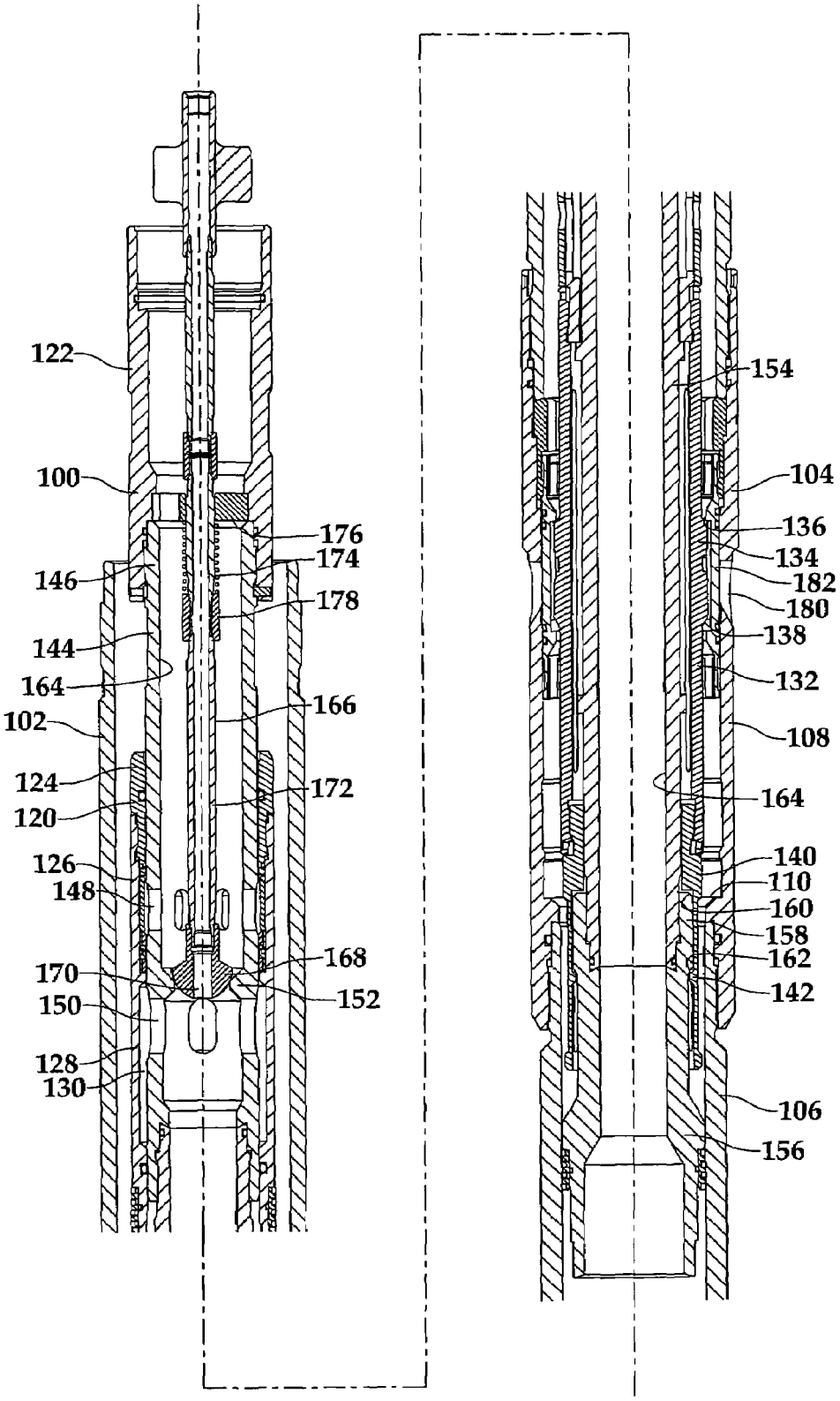
Figure 2E:
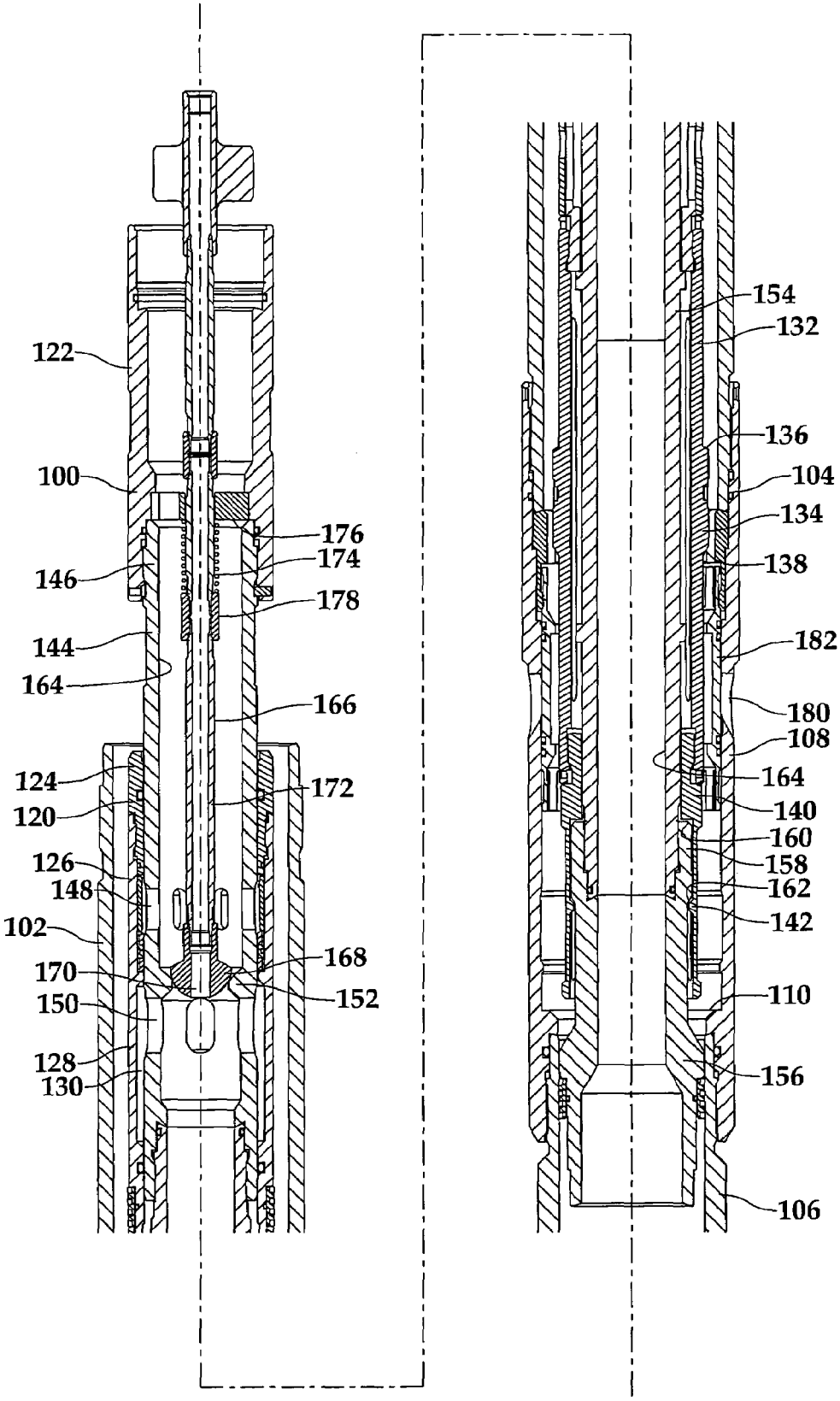

For example, reverse out valve 100 can be moved upwardly though hone bore member 106 in its reverse position without swabbing the formation as seen in FIG. 2C. Specifically, reverse out valve 100 has moved up to a point where the radially expanded outer regions 134 of indicating collet 132 have engaged with sliding sleeve 182. In this position, further upward movement of reverse out valve 100 relative to completion string 102 will shift sliding sleeve 182 upwardly relative to circulation ports 180 of circulation member 104 to prevent flow therethrough, as best seen in FIG. 2D. Further upward movement of reverse out valve 100 relative to completion string 102 will release the radially expanded outer regions 134 of indicating collet 132 from sliding sleeve 182, as best seen in FIG. 2E. Additional upward movement of reverse out valve 100 relative to completion string 102 can now be used to position the service tool for the reverse out process.

Figure 2F:
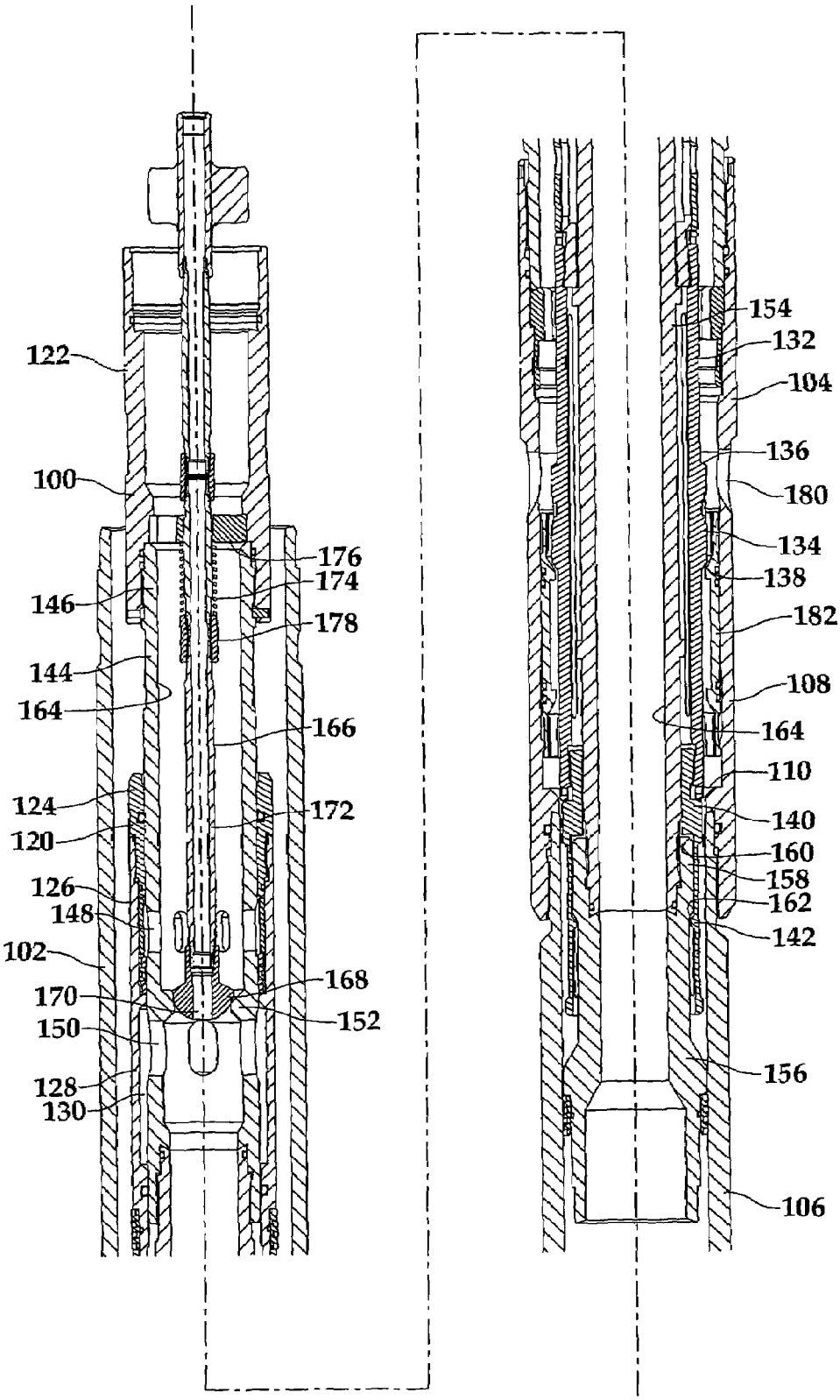

Reverse out valve 100 can also be moved downwardly though hone bore member 106 in its reverse position without swabbing the formation as seen in FIG. 2F. Specifically, reverse out valve 100 has moved down to a point where the radially expanded outer regions 134 of indicating collet 132 have engaged with sliding sleeve 182 and shifted sliding sleeve 182 downwardly relative to circulation ports 180 of circulation member 104 to allow flow therethrough. Further downward movement of reverse out valve 100 relative to completion string 102 will cause reverse out valve 100 to be shifted from its reverse position back to its circulating position.

Figure 2G:
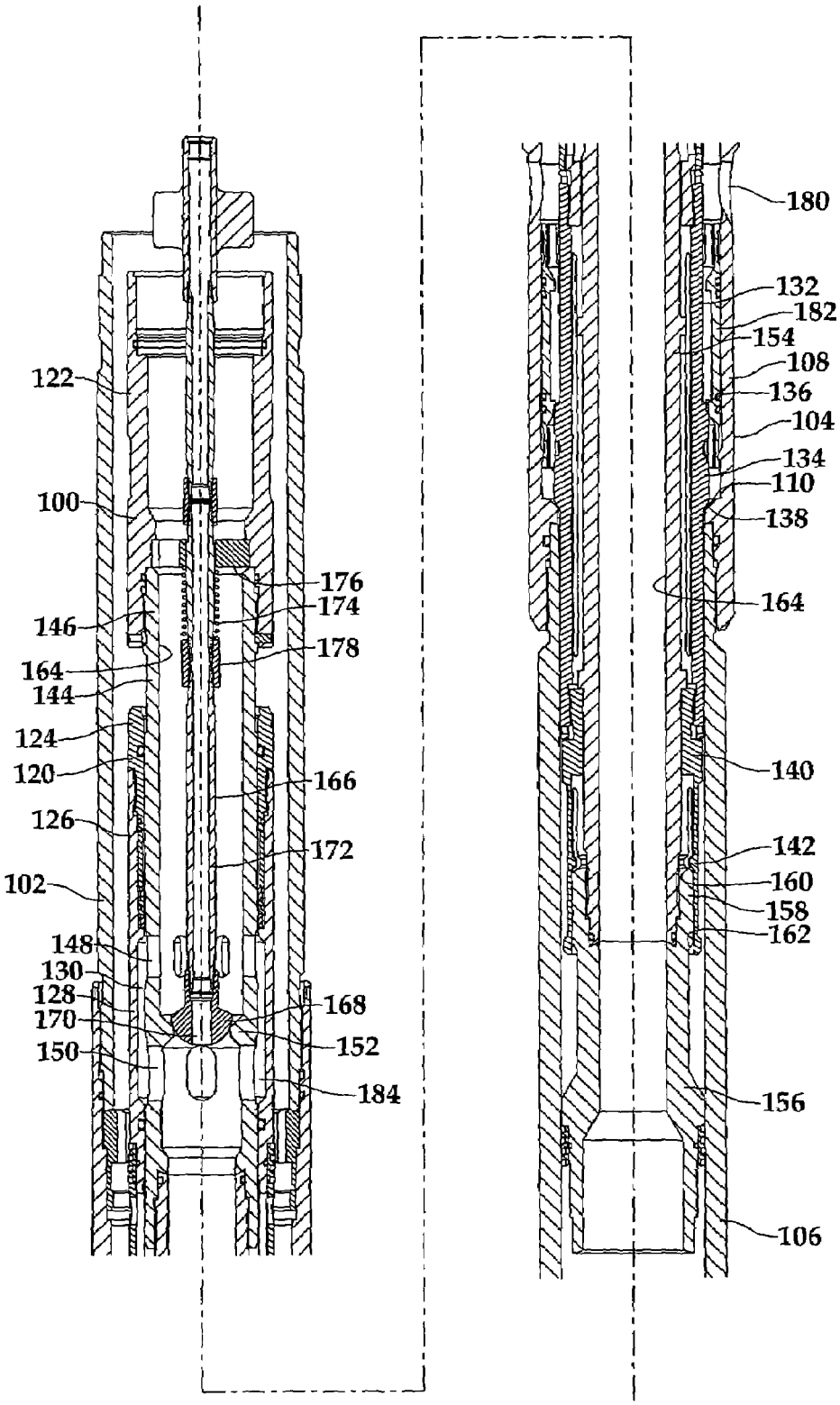

As illustrated in FIG. 2G, shoulder 138 of indicating collet 132 is in contact with shoulder 110 of circulation member 104. As sufficient upward force is applied against shoulder 138 of indicating collet 132 by shoulder 110 of circulation member 104, the radially inwardly projecting members 142 of positioning collet 140 are outwardly urged over shoulder 162 of lower connector 156. As radially inwardly projecting members 142 slide upwardly over radially expanded outer portion 158 of lower connector 156, bypass passageway 184 is opened as side wall ports 150 and side wall ports 148 are placed in fluid communication via bypass region 130. As stated above, in this configuration there are up to three independent fluid paths through reverse out valve 100. Specifically, if reverse out valve 100 were moved downwardly relative to completion string 102, fluid could travel through bypass passageway 184, through central flow path 164 by moving valve element 168 off valve seat 152 and through flow tube 172 via fluid passageway 170. In addition, if reverse out valve 100 were moved upwardly relative to completion string 102, fluid could travel through bypass passageway 184 and through flow tube 172 then fluid passageway 170. In this manner, movement of reverse out valve 100 in its circulating position either upwardly or downwardly relative to completion string 102 will not cause swabbing of the formation. Once reverse out valve 100 is in the circulation position as depicted in FIG. 2G, reverse out valve 100 could be retrieved to the surface or moved downwardly through hone bore member 106.

As should be apparent to those skilled in the art, reverse out valve 100 can be moved upwardly through hone bore member 106 to operate from its circulating position to its reverse position and downwardly through hone bore member 106 to operate from its reverse position to its circulating position as many times as desired by the operator depending upon the treatment regimen. Importantly, this upward and downward movement will not cause swabbing of the formation as there are up to three independent fluid paths through reverse out valve 100 in the circulating position and up to two independent fluid paths through reverse out valve 100 in the reverse position.

Figure 3A:
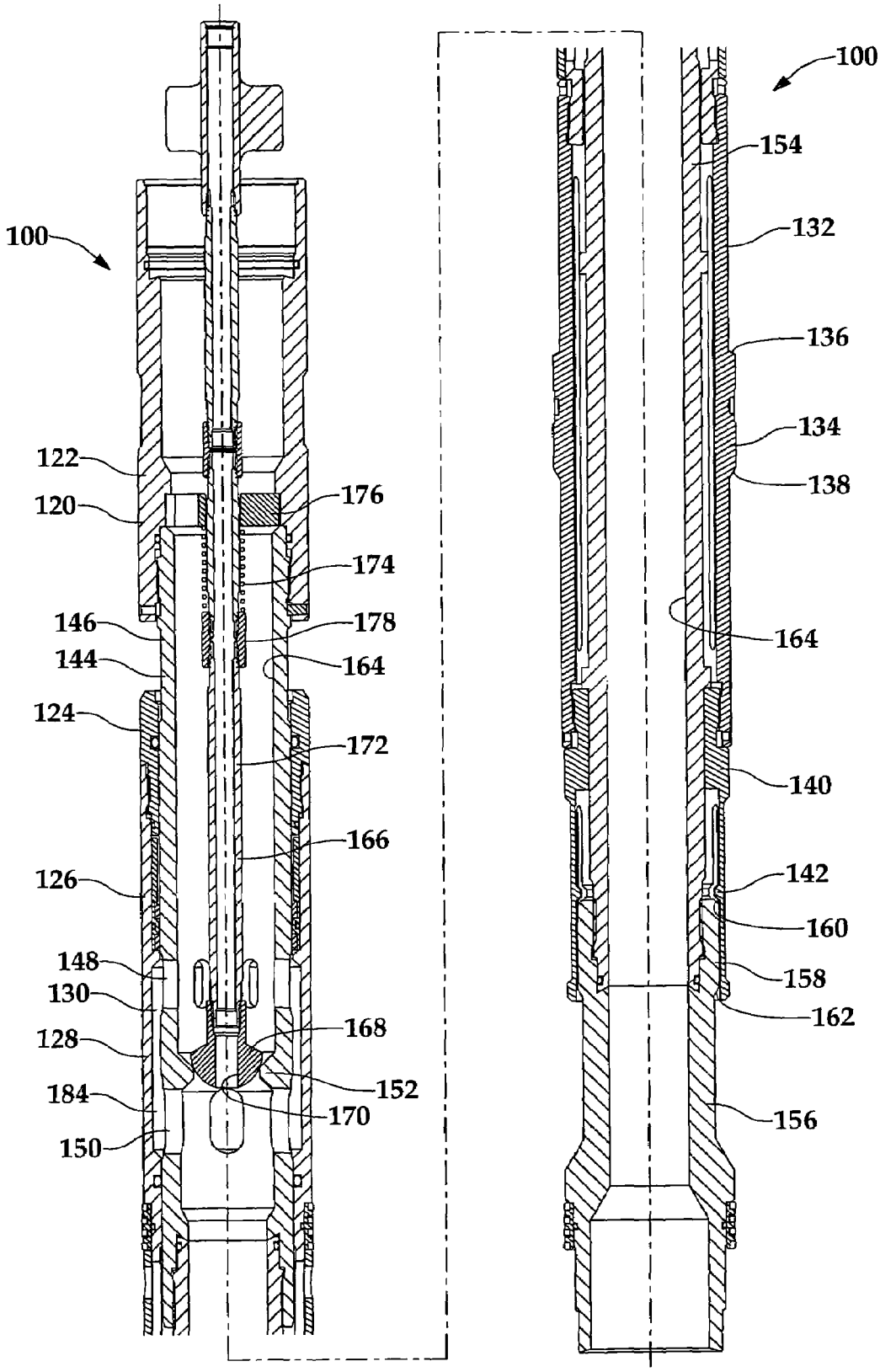
FIGS. 3A-3B are cross sectional views of successive axial sections of a reverse out valve of the present invention in two positions.
Figure 3B:
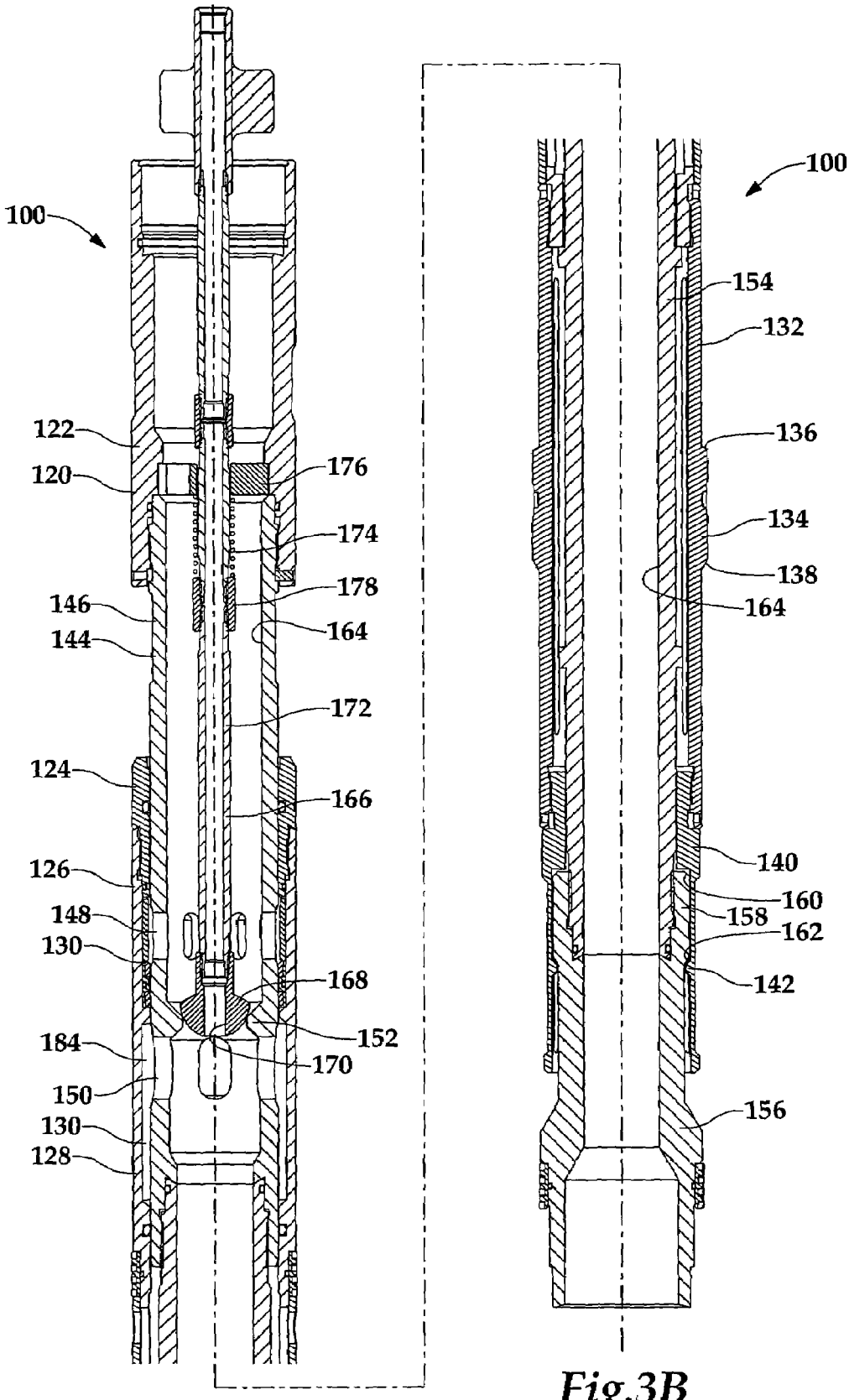

Referring now to FIGS. 3A-3B, therein are depicted successive axial sections of a reverse out valve 100 in its circulating position and its reverse position, respectively. Reverse out valve 100 includes outer housing 120 that comprises upper connector 122, upper adaptor 124, bypass housing member 126, indicating collet 132 and positioning collet 140. Bypass housing member 126 has a radially expanded internal portion 128 that defines the exterior of a bypass region 130. Indicating collet 132 has one or more radially expanded outer regions 134 each including an upper shoulder 136 and a lower shoulder 138. Positioning collet 140 includes one or more radially inwardly projecting members 142. Reverse out valve 100 also includes mandrel 144 that comprises upper connector 146, intermediate member 154 and lower connector 156. Upper connector 146 includes a first series of side wall ports 148 and a second series of side wall ports 150 with a valve seat 152 positioned therebetween. Lower connector 156 has a radially expanded outer portion 158 that includes an upper shoulder 160 and a lower shoulder 162. Mandrel 144 defines a central flow path 164 having a valve element assembly 166 positioned therein. Valve element assembly 166 includes a valve element 168 that is sealingly engageable with valve seat 152 and a flow tube 172, the interior of which is in fluid communication with fluid passageway 170 of valve element 168. A spiral wound compression spring 174 is positioned around flow tube 172 and between a spring support member 176 of upper connector 122 and a spring support member 178 of flow tube 172.

In FIG. 3A, reverse out valve 100 is in its circulating position. Specifically, when a fluid slurry is pumped down a service tool including reverse out valve 100, the fluid slurry exits the cross over ports of the service tool and enters the annulus to the exterior of the completion string via the circulation ports of the completion string. The fluid slurry travels in the annulus and deposits its gravel around the sand control screens of the completion string. Some of the fluid carrier will pass through the sand control screens and into the interior of the completion string. The fluid carrier will then travel up the wash pipe of the service tool that is in fluid communication with central flow path 164 of mandrel 144. The fluid carrier then passes through bypass passageway 184 that is formed when side wall ports 150 and side wall ports 148 are in fluid communication via bypass region 130. In addition, the fluid carrier may pass through the one way valve created by valve element 168 and valve seat 152 by overcoming the spring force of spring 174 to move valve element 168 off seat. Further, a portion of the fluid carrier may pass through fluid passageway 170 and flow tube 172. This return fluid then exits the cross over ports of the service tool into the annulus above the packer for return to the surface.

In FIG. 3B, reverse out valve 100 is in its reverse position. Specifically, when a fluid is pumped down the annulus of the service tool including reverse out valve 100, the fluid slurry enters the cross over ports of the service tool. The fluid then returns to the surface up the work string carrying the gravel left behind in the service tool and the work string. This fluid is substantially prevented from flowing toward the formation down through reverse out valve 100. Specifically, the bypass passageway 184 is closed and the one way valve created by valve element 168 and valve seat 152 is in its sealed configuration due to the spring force of spring 174 and the fluid pressure above valve element 168. Some fluid is allowed to flow toward the formation down through reverse out valve 100 via fluid passageway 170 and flow tube 172. As the cross sectional area of flow tube 172 is relatively small and the length of flow tube 172 is relatively long, however, only a minimal amount of fluid is allowed to flow toward the formation. This fluid path through reverse out valve 100 prevents swabbing of the formation even if reverse out valve 100, in its reverse position, is moved upwardly relative to the completion string as long as the rate of such movement is maintained below a predetermined threshold.

Figure 4A:
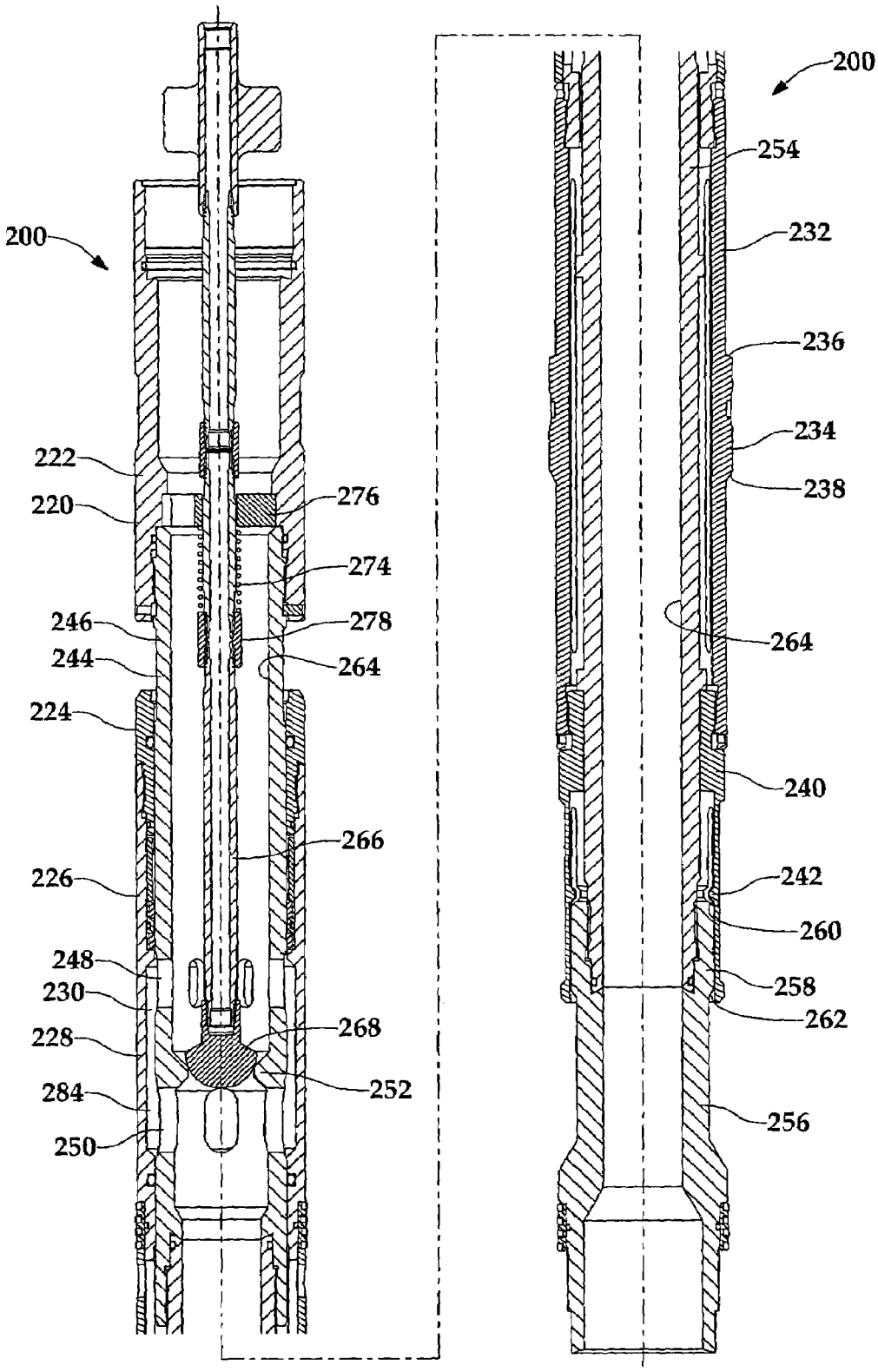
FIGS. 4A-4B are cross sectional views of successive axial sections of a reverse out valve of the present invention in two positions.
Figure 4B:
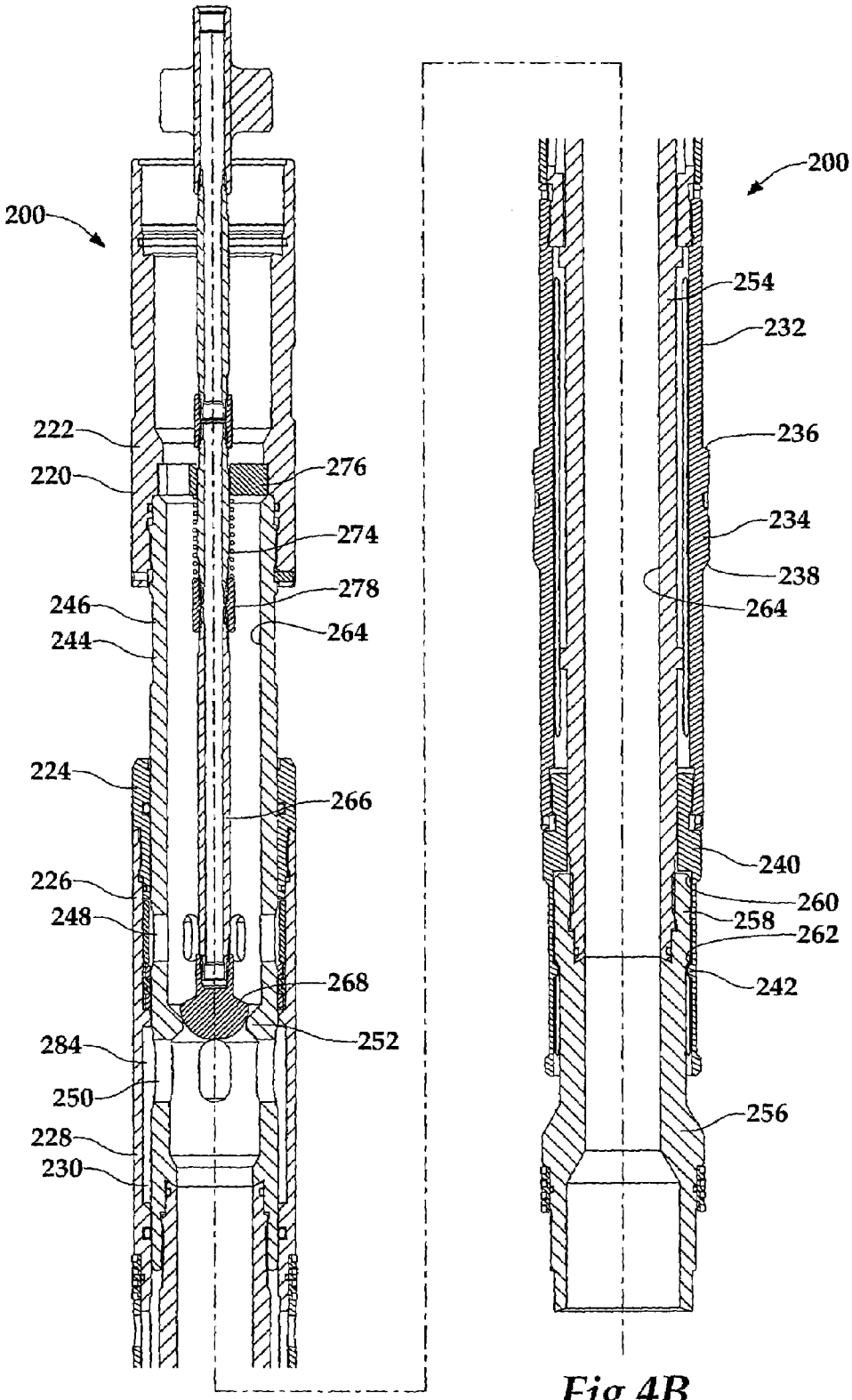

Referring now to FIGS. 4A-4B, therein are depicted successive axial sections of a reverse out valve 200 in its circulating position and its reverse position, respectively. Reverse out valve 200 includes outer housing 220 that comprises upper connector 222, upper adaptor 224, bypass housing member 226, indicating collet 232 and positioning collet 240. Bypass housing member 226 has a radially expanded internal portion 228 that defines the exterior of a bypass region 230. Indicating collet 232 has one or more radially outwardly expanded outer regions 234 each including an upper shoulder 236 and a lower shoulder 238. Positioning collet 240 includes one or more radially inwardly projecting members 242. Reverse out valve 200 also includes mandrel 244 that comprises upper connector 246, intermediate member 254 and lower connector 256. Upper connector 246 includes a first series of side wall ports 248 and a second series of side wall ports 250 with a valve seat 252 positioned therebetween. Lower connector 256 has a radially expanded outer portion 258 that includes an upper shoulder 260 and a lower shoulder 262. Mandrel 244 defines a central flow path 264 having a valve element assembly 266 positioned therein. Valve element assembly 266 includes a valve element 268 that is sealingly engageable with valve seat 152. A spiral wound compression spring 274 is positioned around valve element assembly 266 and between a spring support member 276 of upper connector 222 and a spring support member 278 of valve element assembly 266.

In FIG. 4A, reverse out valve 200 is in its circulating position. Specifically, when a fluid slurry is pumped down a service tool including reverse out valve 200, the fluid slurry exits the cross over ports of the service tool and enters the annulus to the exterior of the completion string via the circulation ports of the completion string. The fluid slurry travels in the annulus and deposits its gravel around the sand control screens of the completion string. Some of the fluid carrier will pass through the sand control screens and into the interior of the completion string. The fluid carrier will then travel up the wash pipe of the service tool that is in fluid communication with central flow path 264 of mandrel 244. The fluid carrier then passes through bypass passageway 284 that is formed when side wall ports 250 and side wall ports 248 are in fluid communication via bypass region 230. In addition, the fluid carrier may pass through the one way valve created by valve element 268 and valve seat 252 by overcoming the spring force of spring 274 to move valve element 268 off seat. This return fluid then exits the cross over ports of the service tool into the annulus above the packer for return to the surface.

In FIG. 4B, reverse out valve 200 is in its reverse position. Specifically, when a fluid is pumped down the annulus of the service tool including reverse out valve 200, the fluid slurry enters the cross over ports of the service tool. The fluid then returns to the surface up the work string carrying the gravel left behind in the service tool and the work string. This fluid is prevented from flowing toward the formation down through reverse out valve 200. Specifically, the bypass passageway 284 is closed and the one way valve created by valve element 268 and valve seat 252 is in its sealed configuration due to the spring force of spring 274 and the fluid pressure above valve element 268. In the reverse position of reverse out valve 200, some swabbing of the formation could occur if reverse out valve 200 is moved upwardly relative to the completion string.

Referring now to FIGS. 5A-5D, therein are depicted successive axial sections of a reverse out valve 300 in its run-in position, its circulating position, its bypass closed position and its reverse position, respectively. Reverse out valve 300 includes an axially extending, generally tubular outer housing 302. Outer housing 302 includes a substantially tubular upper connector 304 adapted to threadedly receive the pin end of another tubular member of the service tool such as a cross over tool. Outer housing 302 also includes a substantially tubular upper adaptor 306 that is threadedly and sealingly coupled to the upper end of an axially extending, generally tubular indicating collet 308. Indicating collet 308 has one or more radially expanded outer regions 310 each including an upper shoulder 312 and a lower shoulder 314. Indicating collet 308 is threadedly and sealingly coupled to the upper end of an axially extending, generally tubular intermediate connector 316. Intermediate connector 316 is threadedly and sealingly coupled to the upper end of an axially extending, generally tubular bypass housing member 318. Bypass housing member 318 has a radially expanded internal portion 320 that defines the exterior of a bypass region 322. Bypass housing member 318 is threadedly and sealingly coupled to the upper end of an axially extending, generally tubular positioning collet 324. Positioning collet 324 includes one or more radially inwardly projecting members 326. Outer housing 302 also includes a substantially tubular lower connector 328 that is threadedly and sealingly coupled to the upper end of an axially extending, generally tubular lower connector extension 330. Lower connector extension 330 is threadedly and sealingly coupled to the upper end of an axially extending, generally tubular slotted housing member 332.

Reverse out valve 300 also includes an axially extending, generally tubular mandrel 334. Mandrel 334 includes an axially extending, generally tubular upper connector 336 that is threadedly and sealingly coupled to the lower end of upper connector 304 of outer housing 302. Upper connector 336 includes a series of side wall ports 338. Threadedly and sealingly coupled to the lower end of upper connector 336 is an axially extending, generally tubular intermediate member 340. Intermediate member 340 includes a valve seat 342, a series of side wall ports 344 and a radially expanded outer portion 346 that includes an upper shoulder 348 and a lower shoulder 350. Mandrel 334 also includes an axially extending, generally tubular lower member 354. Lower member 354 includes a plurality of radially outwardly extending rails 356. Lower member 354 is threadedly and sealingly coupled to an axially extending, generally tubular lower connector 358 that is adapted to be threadedly received in the box end of another tubular member of the service tool. Mandrel 334 defines a central flow path 360.

Reverse out valve 300 further includes an axially extending, generally tubular valve element assembly 362 that is positioned within central flow path 360 of mandrel 334. Valve element assembly 362 includes a valve element 364 that is sealingly engageable with valve seat 342 of mandrel 334. Valve element 364 includes a fluid passageway 366, a plurality of ports 368 and a seal member 370 such as an o-ring seal. Valve element assembly 362 also includes a flow tube 372, the interior of which is in fluid communication with fluid passageway 366. A metallic force generator such as a spiral wound compression spring 374 is positioned around flow tube 372 and between a spring support member 376 of lower member 354 and a spring support member 378 of flow tube 372.

Figure 5A:
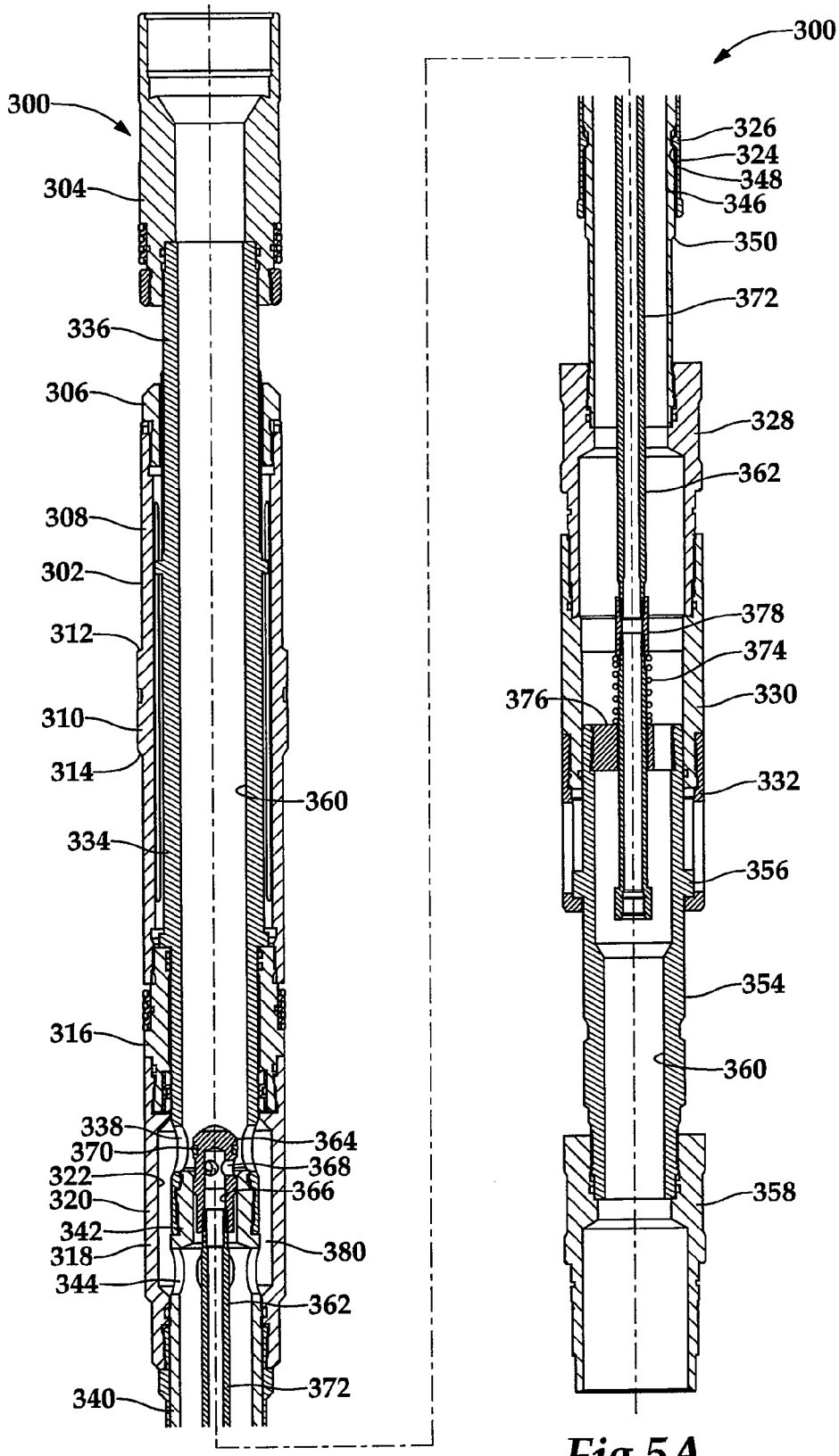
FIGS. 5A-5D are cross sectional views of successive axial sections of a reverse out valve of the present invention in four positions.

In FIG. 5A, reverse out valve 300 is in its run-in position. Specifically, when reverse out valve 300 is run-in the wellbore on the service tool and placed within the completion string, flow through reverse out valve 300 prevents swabbing the formation. In this configuration, if reverse out valve 300 is moved upwardly or downwardly relative to the completion string, fluid travels at least through bypass passageway 380 formed between side wall ports 338 and side wall ports 344 via bypass region 322. In addition, some fluid flow is allowed through flow tube 372 via fluid passageway 366 and ports 368. Also, some fluid flow may be allowed through central flow path 360.

Figure 5B:
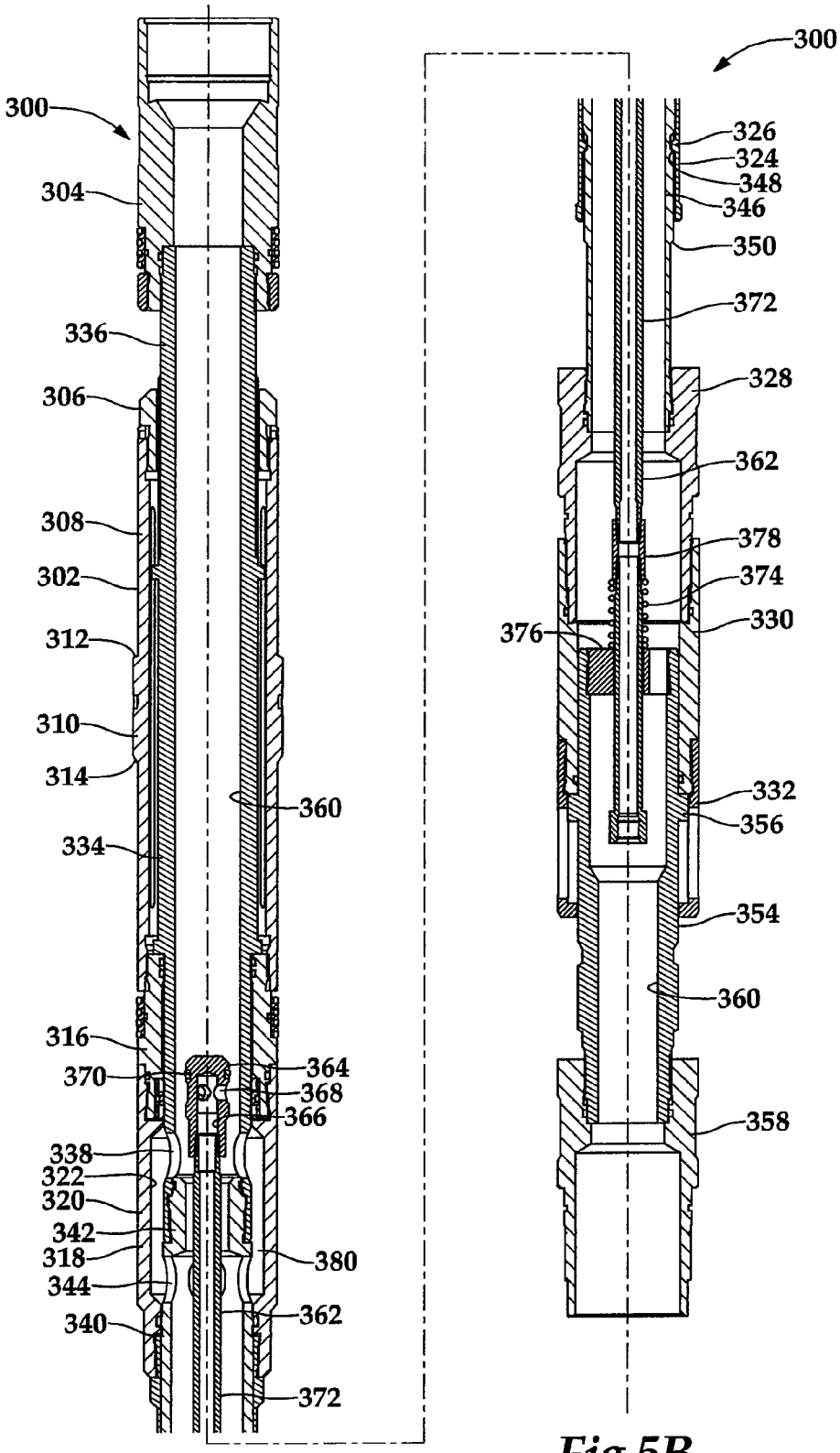

In FIG. 5B, reverse out valve 300 is in its circulating position. In this configuration, weight is set down on lower connector 358 which causes lower member 354 to move upwardly relative to slotted housing member 332 with rails 356 moving within the slots of slotted housing member 332. In addition, this causes valve element 364 to move upwardly relative to valve seat 342 which fully opens a flow path through valve seat 342. Now, when a fluid slurry is pumped down the service tool including reverse out valve 300, the fluid slurry exits the cross over ports of the service tool and enters the annulus to the exterior of the completion string via the circulation ports of the completion string. The fluid slurry travels in the annulus and deposits its gravel around the sand control screens of the completion string. Some of the fluid carrier will pass through the sand control screens and into the interior of the completion string. The fluid carrier will then travel up the wash pipe of the service tool that is in fluid communication with central flow path 360 of mandrel 334. The fluid carrier then passes through bypass passageway 380, through the flow path through valve seat 342 and through flow tube 372, fluid passageway 366 and ports 368. This return fluid then exits the cross over ports of the service tool into the annulus above the packer for return to the surface. Once the weight is removed from lower connector 358 by upward movement of reverse out valve 300, reverse out valve 300 shifts from its circulating configuration to its run-in configuration as depicted in FIG. 5A.

Figure 5C:
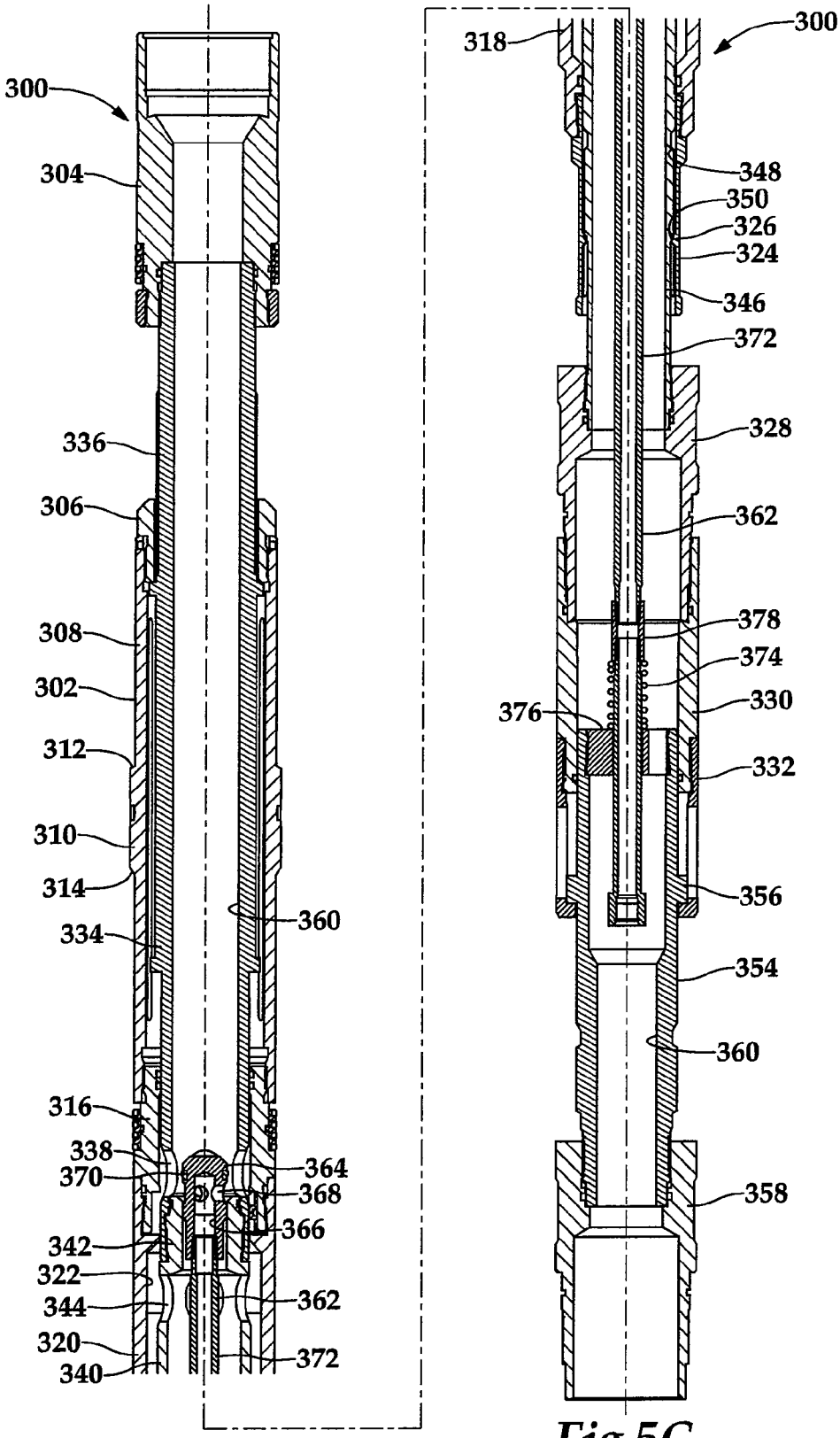

In FIG. 5C, reverse out valve 300 is in its bypass closed position. Reverse out valve 300 is operated from its run-in configuration to its bypass closed configuration by upward movement of reverse out valve 300 relative to the completion string such that a sufficient downward force is applied against shoulder 312 of indicating collet 308 by a shoulder of the hone bore member which outwardly urges radially inwardly projecting members 326 of positioning collet 324 over shoulder 348 of intermediate member 340. As radially inwardly projecting members 326 slide downwardly over radially expanded outer portion 346 of intermediate member 340, bypass passageway 380 is disable as side wall ports 338 and side wall ports 344 are in no longer in fluid communication via bypass region 322. In this configuration, if reverse out valve 300 is moved upwardly or downwardly relative to the completion string, fluid flow is allowed through flow tube 372 via fluid passageway 366 and ports 368. In addition, some fluid flow may be allowed through central flow path 360.

Figure 5D:
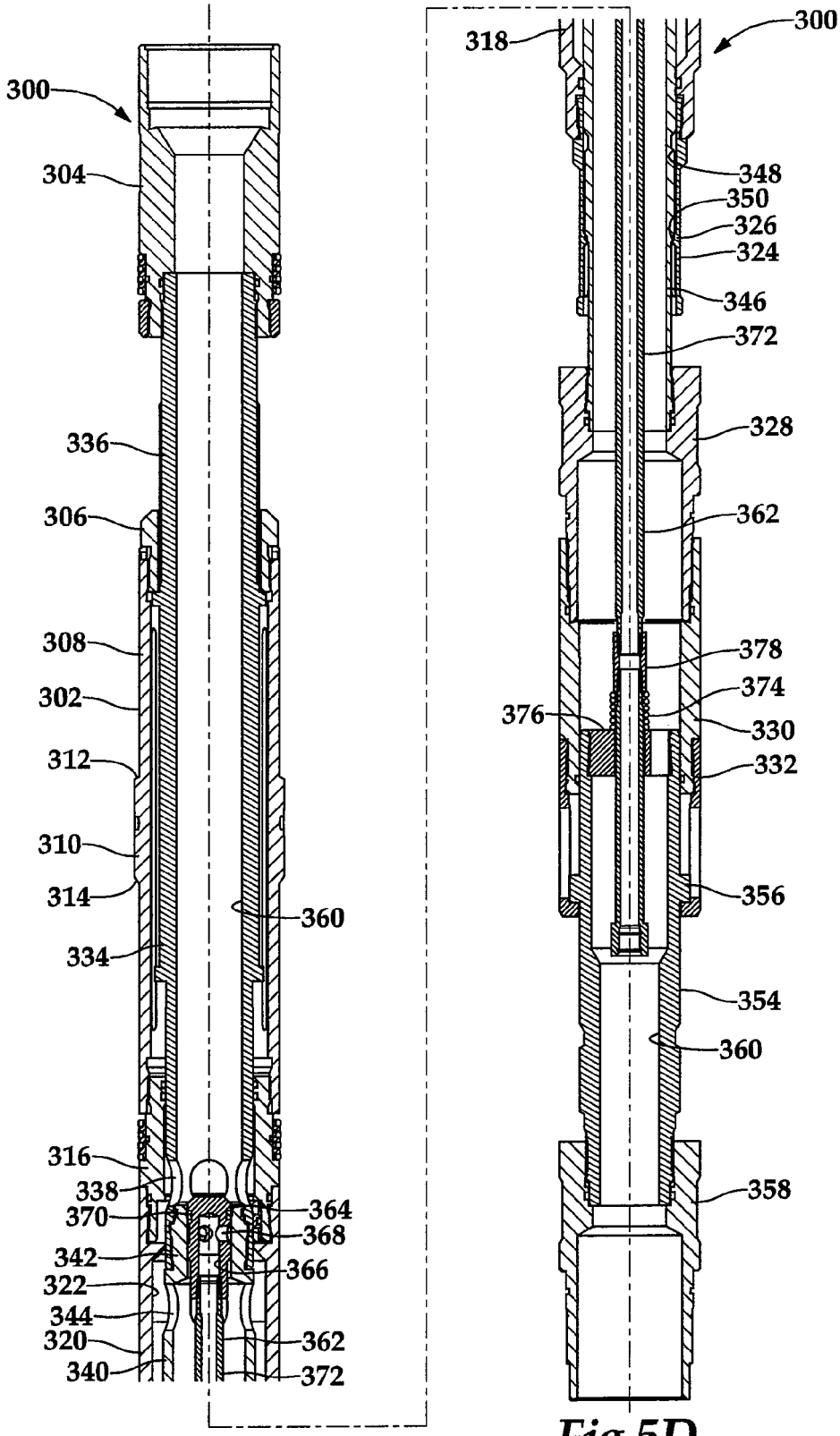

In FIG. 5D, reverse out valve 300 is in its reverse position. Reverse out valve 300 is operated from its bypass closed configuration to its reverse configuration by increasing the pressure above valve element 364 which urges valve element 364 downwardly relative to valve seat 342 placing seal member 370 within valve seat 342. This downward movement of valve element 364 relative to valve seat 342 compresses spring 374. In this configuration, the fluid pumped down the annulus of the service tool including reverse out valve 300 enters the cross over ports of the service tool, downwardly shifts valve element 364 relative to valve seat 342 and returns to the surface up the work string carrying the gravel left behind in the service tool and the work string. This fluid is prevented from flowing toward the formation down through reverse out valve 300. Specifically, bypass passageway 380 is closed, the one way valve created by valve element 364 and valve seat 342 is in its sealed configuration and ports 368 are behind seal member 370 which disables fluid flow into fluid passageway 366 and flow tube 372. Once the fluid pressure is removed from above seal element 364, spring 374 urges valve element 364 upwardly relative to valve seat 342, which returns reverse out valve 300 to its bypass closed configuration as depicted in FIG. 5C. As state above, in this configuration, if reverse out valve 300 is moved upwardly or downwardly relative to the completion string, fluid flow is allowed through flow tube 372 via fluid passageway 366 and ports 368. In addition, some fluid flow may be allowed through central flow path 360.

Figure 6A:
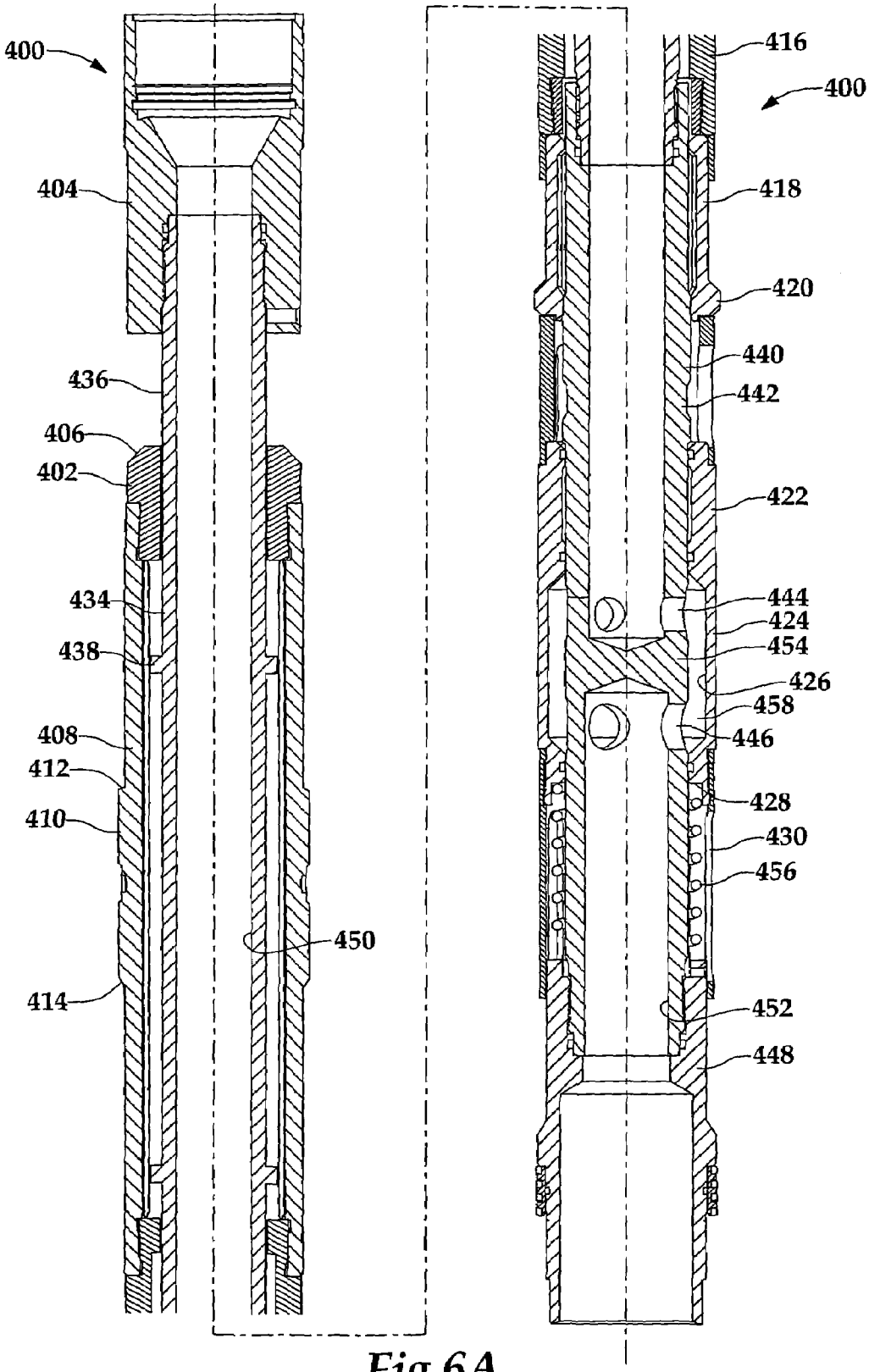
FIGS. 6A-6B are cross sectional views of successive axial sections of a reverse out valve of the present invention in two positions.
Figure 6B:
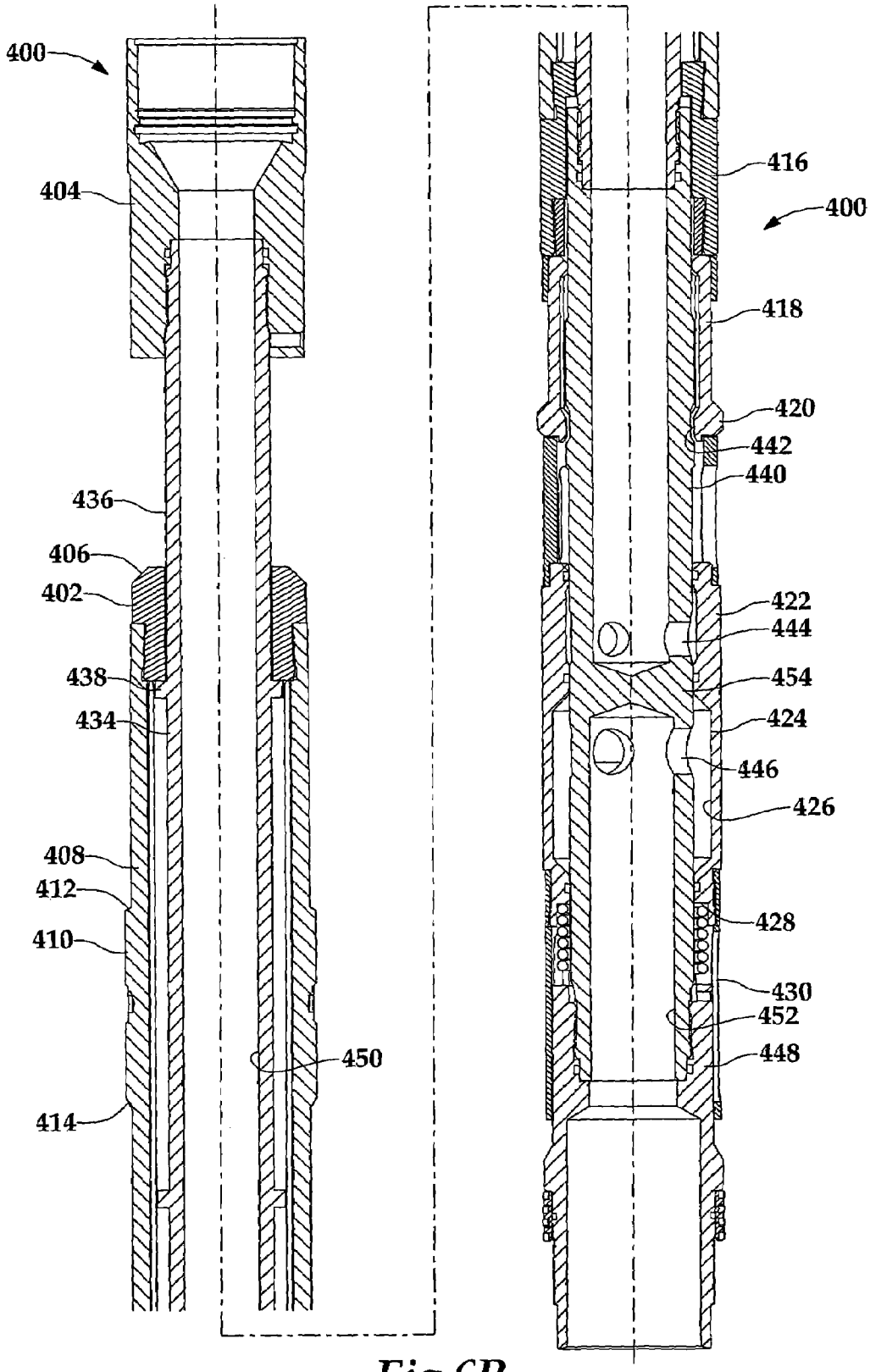

Referring now to FIGS. 6A-6B, therein are depicted successive axial sections of a reverse out valve 400 in its circulating position and its reverse position, respectively. Reverse out valve 400 includes an axially extending, generally tubular outer housing 402. Outer housing 402 includes a substantially tubular upper connector 404 adapted to threadedly receive the pin end of another tubular member of the service tool such as a cross over tool. Outer housing 402 also includes a substantially tubular upper adaptor 406 that is threadedly and sealingly coupled to the upper end of an axially extending, generally tubular indicating collet 408. Indicating collet 408 has one or more radially expanded outer regions 410 each including an upper shoulder 412 and a lower shoulder 414. Indicating collet 408 is threadedly and sealingly coupled to the upper end of an axially extending, generally tubular intermediate connector 416. Intermediate connector 416 is threadedly and sealingly coupled to the upper end of an axially extending, generally tubular positioning collet 418. Positioning collet 418 includes one or more radially expanded members 420. Positioning collet 418 is coupled to the upper end of an axially extending, generally tubular bypass housing member 422. Bypass housing member 422 has a radially expanded internal portion 424 that defines the exterior of a bypass region 426. Bypass housing member 422 also has a lower shoulder 428. Bypass housing member 422 is threadedly and sealingly coupled to the upper end of an axially extending, generally tubular spring housing 430.

Reverse out valve 400 also includes an axially extending, generally tubular mandrel 434. Mandrel 434 includes an axially extending, generally tubular upper connector 436 that is threadedly and sealingly coupled to the lower end of upper connector 404 of outer housing 402. Upper connector 436 includes a radial outwardly expanded region 438. Threadedly and sealingly coupled to the lower end of upper connector 436 is an axially extending, generally tubular intermediate member 440. Intermediate member 440 includes a radially reduced region 442, a first series of side wall ports 444 and a second series of side wall ports 446. Intermediate member 440 is threadedly and sealingly coupled to an axially extending, generally tubular lower connector 448 that is adapted to be threadedly received in the box end of another tubular member of the service tool. Mandrel 434 defines a first central flow path 450 and a second central flow path 452 that are separated by a fluid flow control element depicted as a solid member 454 positioned axially between side wall ports 444 and side wall ports 446. An axially force generator depicted as a spiral wound compression spring 456 is positioned around the lower portion of intermediate member 440.

In FIG. 6A, reverse out valve 400 is in its circulating position. In this configuration, when a fluid slurry is pumped down the service tool including reverse out valve 400, the fluid slurry exits the cross over ports of the service tool and enters the annulus to the exterior of the completion string via the circulation ports of the completion string. The fluid slurry travels in the annulus and deposits its gravel around the sand control screens of the completion string. Some of the fluid carrier will pass through the sand control screens and into the interior of the completion string. The fluid carrier will then travel up the wash pipe of the service tool that is in fluid communication with central flow path 452 of mandrel 434. The fluid carrier then passes through bypass passageway 458 created by side wall ports 444 and side wall ports 446 via bypass region 426. This return fluid then exits the cross over ports of the service tool into the annulus above the packer for return to the surface. In this configuration, if reverse out valve 400 is moved upwardly or downwardly relative to the completion string, fluid travels through bypass passageway 458 which prevents swabbing of the formation.

In FIG. 6B, reverse out valve 400 is in its reverse position. Reverse out valve 400 is operated from its circulating configuration to its reverse configuration by upward movement of reverse out valve 400 relative to the completion string such that a sufficient downward force is applied against shoulder 412 of indicating collet 408 by a shoulder of the hone bore member. As radially expanded members 420 slide downwardly over intermediate member 440, bypass passageway 458 is disable as side wall ports 444 and side wall ports 446 are in no longer in fluid communication via bypass region 426. At the same time, energy is stored in spring 456 due to the compression of spring 456. When the lower end of upper adapter 406 contacts radial outwardly expanded region 438, radially expanded members 420 radially retracts into radially reduced region 442. As long as radially expanded members 420 remain in this retacted position further axial movement of intermediate member 440 relative to bypass housing member 422 is prevented, as such, radially expanded members 420 and intermediate member 440 act as an axial lock when engaged with one another and maintained in such engagement by, for example, the hone bore member of the completion string.

In its reverse position, the fluid pumped down the annulus of the service tool including reverse out valve 400 enters the cross over ports of the service tool and returns to the surface up the work string carrying the gravel left behind in the service tool and the work string. This fluid is prevented from flowing toward the formation down through reverse out valve 400. Specifically, bypass passageway 458 is closed and solid member 454 prevents fluid flow from first central flow path 450 to second central flow path 452. Once radially expanded members 420 are no longer held within radially reduced region 442, the energy stored in spring 456 upwardly urges bypass housing member 422 relative to intermediate member 440, which returns reverse out valve 400 to its circulating position as depicted in FIG. 6A. As such, the only time in which reverse out valve 400 may created a swabbing risk is during the period in which reverse out valve 400 is in its reverse position.

It should be understood by those skilled in the art that reverse out valve 400 could alternatively incorporate additional features into the fluid flow control element to reduce or eliminate the risk of swabbing. For example, a fluid passageway could be included that passes through solid member 454. This fluid passageway could have a relatively small cross sectional area and a relatively long length, similar to the flow tube described below in FIGS. 7A-7B. Alternatively, the passageway could incorporate one of the valve seats described above in FIGS. 2A-5D. In this embodiment, one of the valve elements and flow tube combinations described above in FIGS. 2A-5D or below in FIGS. 8A-8B could also be incorporated into reverse out valve 400 such that reverse out valve 400 can have the advantage of using a spring force to open bypass passageway 458 as well as the advantages of multiple independent fluid paths to prevent swabbing.

Figure 7A:
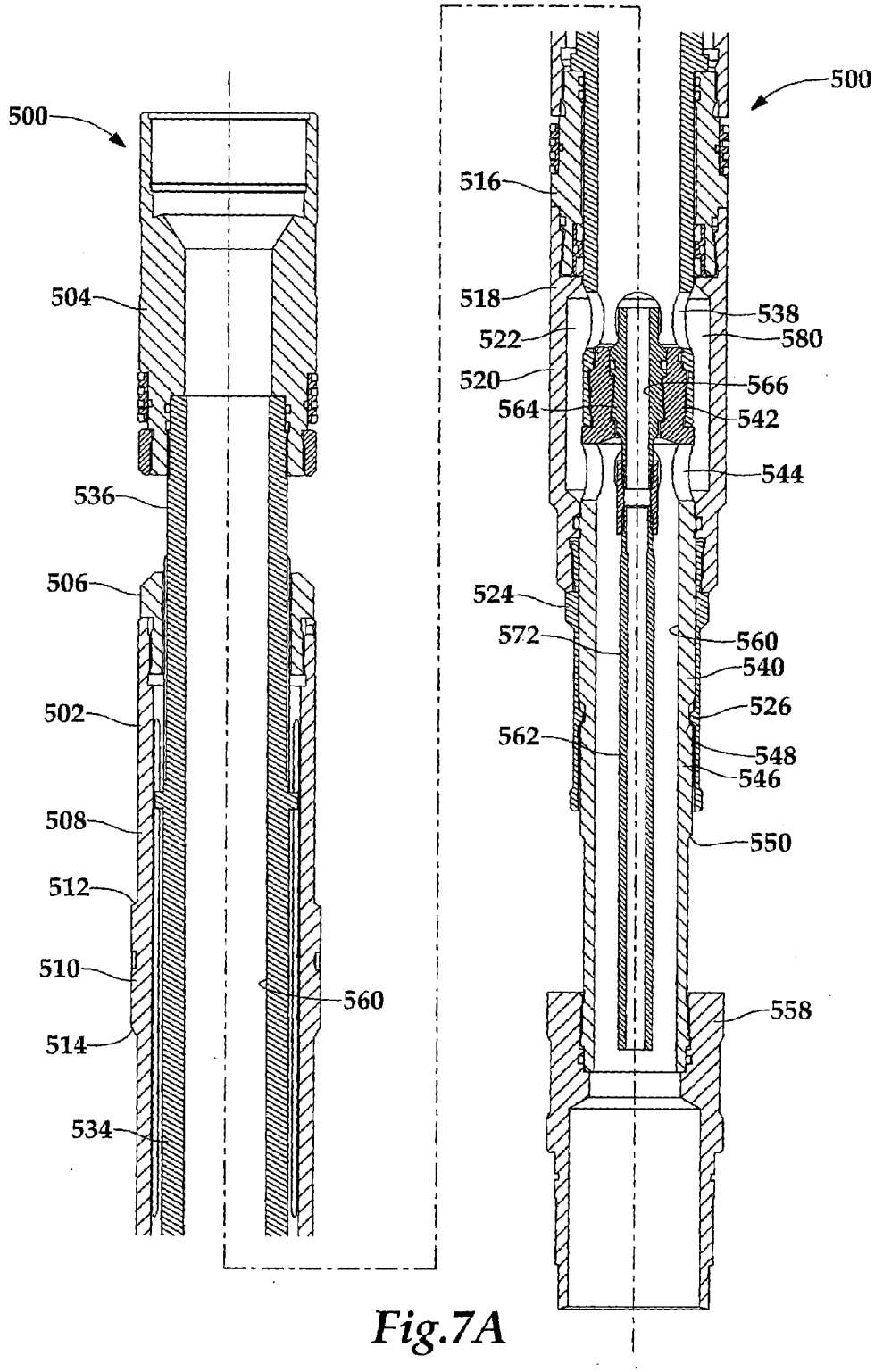
FIGS. 7A-7B are cross sectional views of successive axial sections of a reverse out valve of the present invention in two positions.
Figure 7B:
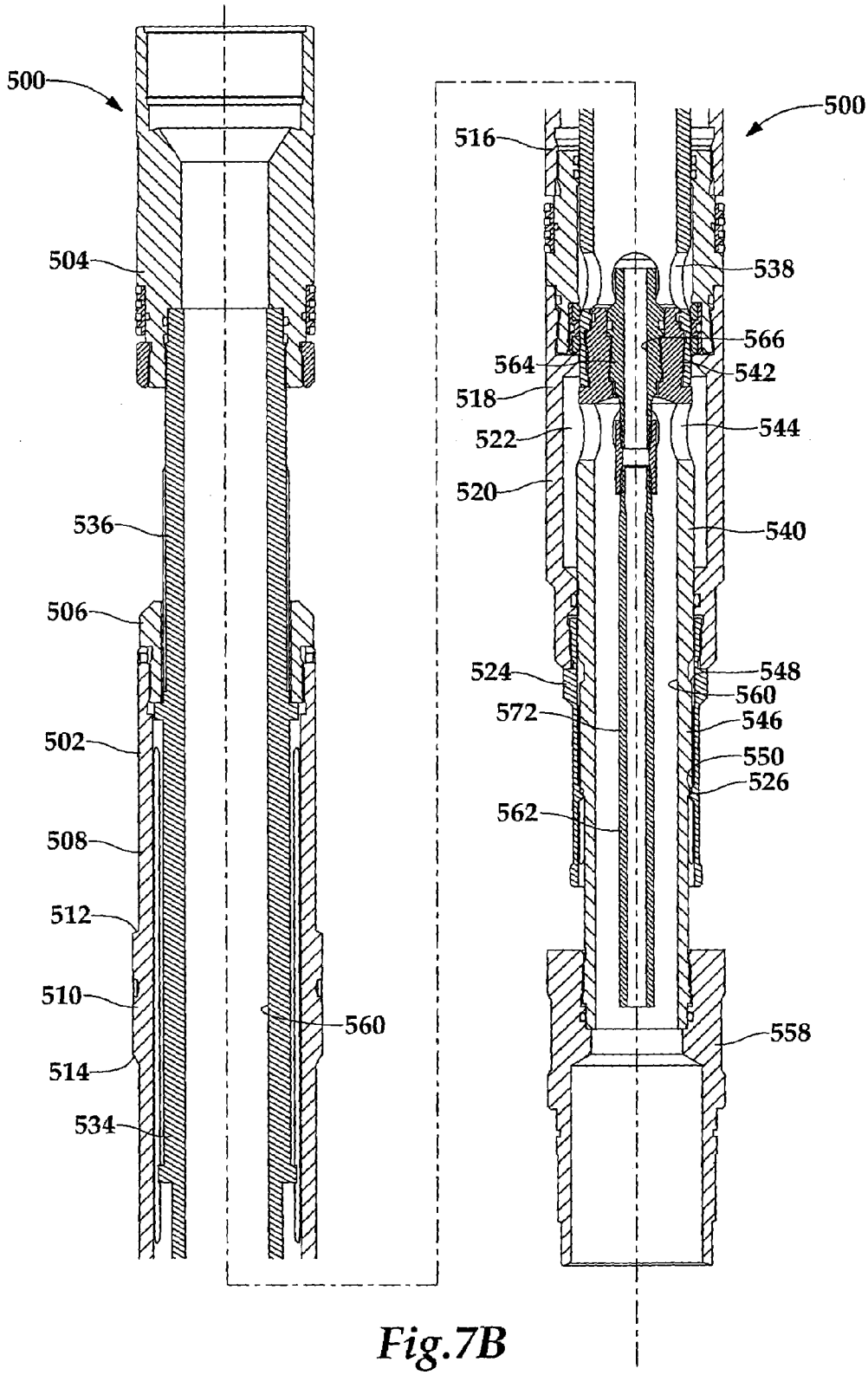

Referring now to FIGS. 7A-7B, therein are depicted successive axial sections of a reverse out valve 500 in its circulating position and its reverse position, respectively. Reverse out valve 500 includes an axially extending, generally tubular outer housing 502. Outer housing 502 includes a substantially tubular upper connector 504 adapted to threadedly receive the pin end of another tubular member of the service tool such as a cross over tool. Outer housing 502 also includes a substantially tubular upper adaptor 506 that is threadedly and sealingly coupled to the upper end of an axially extending, generally tubular indicating collet 508. Indicating collet 508 has one or more radially expanded outer regions 510 each including an upper shoulder 512 and a lower shoulder 514. Indicating collet 508 is threadedly and sealingly coupled to the upper end of an axially extending, generally tubular intermediate connector 516. Intermediate connector 516 is threadedly and sealingly coupled to the upper end of an axially extending, generally tubular bypass housing member 518. Bypass housing member 518 has a radially expanded internal portion 520 that defines the exterior of a bypass region 522. Bypass housing member 518 is threadedly and sealingly coupled to the upper end of an axially extending, generally tubular positioning collet 524. Positioning collet 524 includes one or more radially inwardly projecting members 526.

Reverse out valve 500 also includes an axially extending, generally tubular mandrel 534. Mandrel 534 includes an axially extending, generally tubular upper connector 536 that is threadedly and sealingly coupled to the lower end of upper connector 504 of outer housing 502. Upper connector 536 includes a series of side wall ports 538. Threadedly and sealingly coupled to the lower end of upper connector 536 is an axially extending, generally tubular intermediate member 540. Intermediate member 540 includes a plug seat 542, a series of side wall ports 544 and a radially expanded outer portion 546 that includes an upper shoulder 548 and a lower shoulder 550. Intermediate member 540 is threadedly and sealingly coupled to an axially extending, generally tubular lower connector 558 that is adapted to be threadedly received in the box end of another tubular member of the service tool. Mandrel 534 defines a central flow path 560.

Reverse out valve 500 further includes an axially extending, generally tubular plug element assembly 562 that is positioned within central flow path 560 of mandrel 534. Plug element assembly 562 includes a plug element 564 that is threadably and sealingly engageable with plug seat 542 of mandrel 534. Plug element 542 includes a fluid passageway 566. Plug element assembly 562 also includes a flow tube 572, the interior of which is in fluid communication with fluid passageway 566.

In FIG. 7A, reverse out valve 500 is in its circulating position. In this configuration, if reverse out valve 500 is moved upwardly or downwardly relative to the completion string, fluid travels at least through bypass passageway 580 formed between side wall ports 538 and side wall ports 544 via bypass region 522. In addition, some fluid flow is allowed through flow tube 572 via fluid passageway 566. When a fluid slurry is pumped down the service tool including reverse out valve 500, the fluid slurry exits the cross over ports of the service tool and enters the annulus to the exterior of the completion string via the circulation ports of the completion string. The fluid slurry travels in the annulus and deposits its gravel around the sand control screens of the completion string. Some of the fluid carrier will pass through the sand control screens and into the interior of the completion string. The fluid carrier will then travel up the wash pipe of the service tool that is in fluid communication with central flow path 560 of mandrel 534. The fluid carrier then passes through bypass passageway 580 and through flow tube 572 as well as fluid passageway 566. This return fluid then exits the cross over ports of the service tool into the annulus above the packer for return to the surface.

In FIG. 7B, reverse out valve 500 is in its reverse position. Reverse out valve 500 is operated from its circulating configuration to its reverse configuration by upward movement of reverse out valve 500 relative to the completion string such that a sufficient downward force is applied against shoulder 512 of indicating collet 508 by a shoulder of the hone bore member which outwardly urges radially inwardly projecting members 526 of positioning collet 524 over shoulder 548 of intermediate member 540. As radially inwardly projecting members 526 slide downwardly over radially expanded outer portion 546 of intermediate member 540, bypass passageway 580 is disable as side wall ports 538 and side wall ports 544 are in no longer in fluid communication via bypass region 522. In this configuration, if reverse out valve 500 is moved upwardly or downwardly relative to the completion string, fluid flow is allowed through flow tube 572 via fluid passageway 566.

In its reverse position, when a fluid is pumped down the annulus of the service tool including reverse out valve 500, the fluid slurry enters the cross over ports of the service tool. The fluid then returns to the surface up the work string carrying the gravel left behind in the service tool and the work string. This fluid is substantially prevented from flowing toward the formation down through reverse out valve 500. Specifically, the bypass passageway 580 is closed. Some fluid is allowed to flow toward the formation down through reverse out valve 500 via fluid passageway 566 and flow tube 572. As the cross sectional area of flow tube 572 is relatively small and the length of flow tube 572 is relatively long, however, only a minimal amount of fluid is allowed to flow toward the formation. This fluid path through reverse out valve 500 prevents swabbing of the formation even if reverse out valve 500, in its reverse position, is moved upwardly relative to the completion string as long as the rate of such movement is maintained below a predetermined threshold.

Figure 8A:
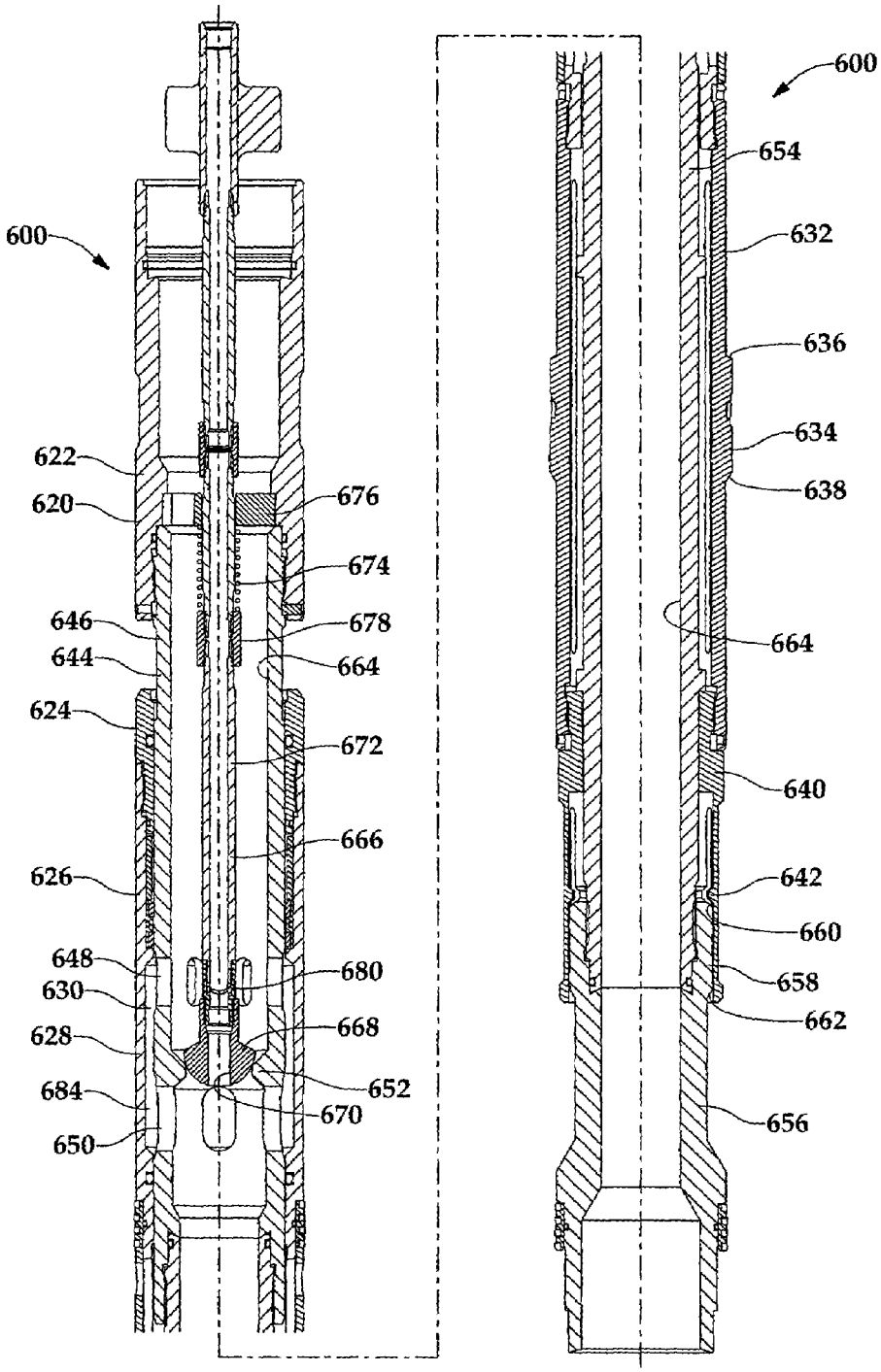
FIGS. 8A-8B are cross sectional views of successive axial sections of a reverse out valve of the present invention in two positions.
Figure 8B:
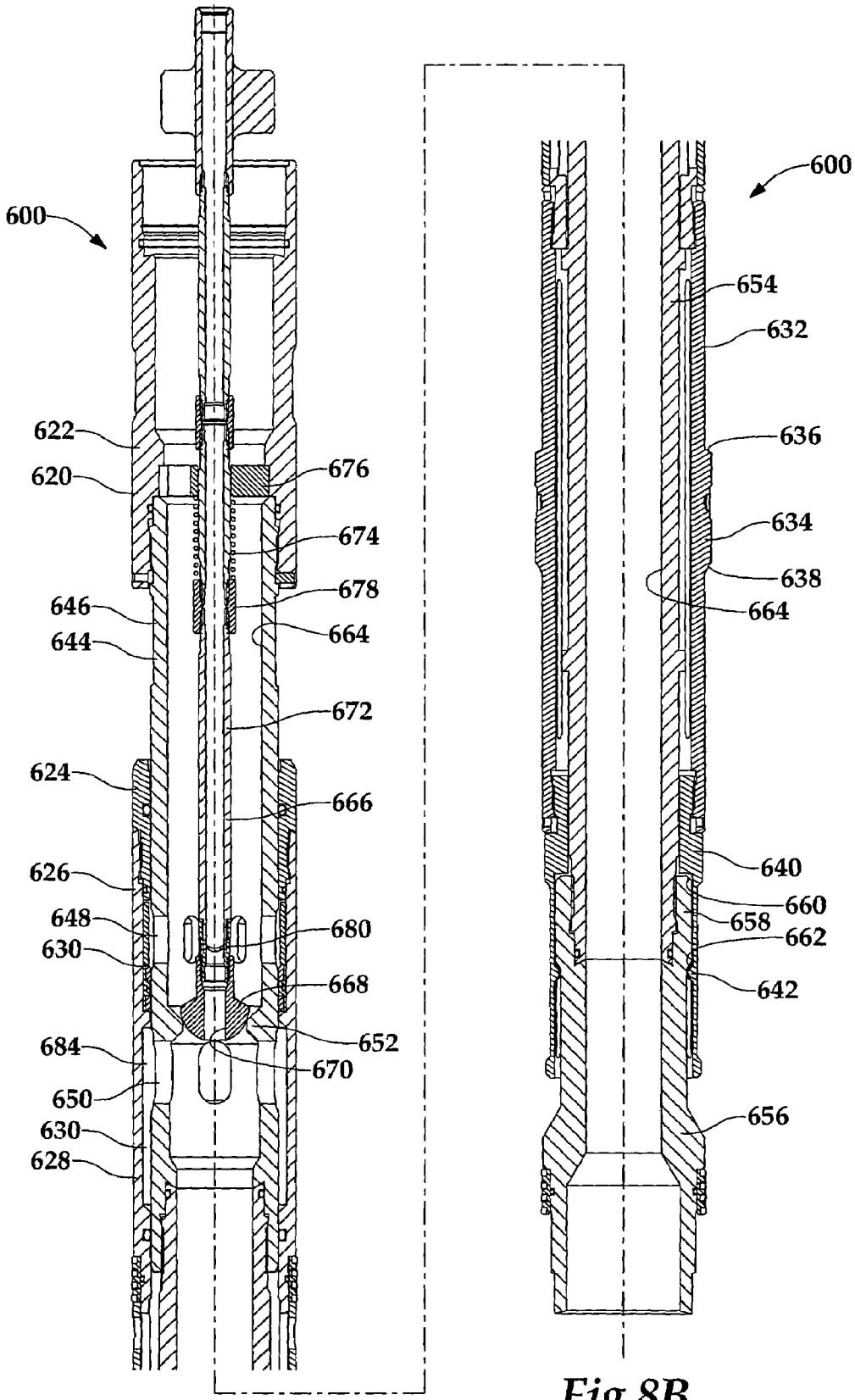

Referring now to FIGS. 8A-8B, therein are depicted successive axial sections of a reverse out valve 600 in its circulating position and its reverse position, respectively. Reverse out valve 600 includes outer housing 620 that comprises upper connector 622, upper adaptor 624, bypass housing member 626, indicating collet 632 and positioning collet 640. Bypass housing member 626 has a radially expanded internal portion 628 that defines the exterior of a bypass region 630. Indicating collet 632 has one or more radially expanded outer regions 634 each including an upper shoulder 636 and a lower shoulder 638. Positioning collet 640 includes one or more radially inwardly projecting members 642. Reverse out valve 600 also includes mandrel 644 that comprises upper connector 646, intermediate member 654 and lower connector 656. Upper connector 646 includes a first series of side wall ports 648 and a second series of side wall ports 650 with a valve seat 652 positioned therebetween. Lower connector 656 has a radially expanded outer portion 658 that includes an upper shoulder 660 and a lower shoulder 662. Mandrel 644 defines a central flow path 664 having a valve element assembly 666 positioned therein. Valve element assembly 666 includes a valve element 668 that is sealingly engageable with valve seat 652 and a flow tube 672, the interior of which is in fluid communication with fluid passageway 670 of valve element 668. A spiral wound compression spring 674 is positioned around flow tube 672 and between a spring support member 676 of upper connector 622 and a spring support member 678 of flow tube 672. Positioned within flow tube 672 is a pressure relief element 680 such as a rupture disk that selectively allows and prevents fluid flow through the interior of flow tube 672.

In FIG. 8A, reverse out valve 600 is in its circulating position. Specifically, when a fluid slurry is pumped down a service tool including reverse out valve 600, the fluid slurry exits the cross over ports of the service tool and enters the annulus to the exterior of the completion string via the circulation ports of the completion string. The fluid slurry travels in the annulus and deposits its gravel around the sand control screens of the completion string. Some of the fluid carrier will pass through the sand control screens and into the interior of the completion string. The fluid carrier will then travel up the wash pipe of the service tool that is in fluid communication with central flow path 664 of mandrel 644. The fluid carrier then passes through bypass passageway 684 that is formed when side wall ports 650 and side wall ports 648 are in fluid communication via bypass region 630. In addition, the fluid carrier may pass through the one way valve created by valve element 668 and valve seat 652 by overcoming the spring force of spring 674 to move valve element 668 off seat. The fluid carrier is selectively prevented from passing through fluid passageway 670 and flow tube 672 by pressure relief element 680 so long as pressure relief element 680 has not been ruptured due to, for example, a pressure that exceeds the burst pressure of pressure relief element 680, in which case a portion of the fluid carrier may pass through fluid passageway 670 and flow tube 672. This return fluid then exits the cross over ports of the service tool into the annulus above the packer for return to the surface.

In FIG. 8B, reverse out valve 600 is in its reverse position. Specifically, when a fluid is pumped down the annulus of the service tool including reverse out valve 600, the fluid slurry enters the cross over ports of the service tool. The fluid then returns to the surface up the work string carrying the gravel left behind in the service tool and the work string. This fluid is entirely or substantially prevented from flowing toward the formation down through reverse out valve 600. Specifically, the bypass passageway 684 is closed and the one way valve created by valve element 668 and valve seat 652 is in its sealed configuration due to the spring force of spring 674 and the fluid pressure above valve element 668. In addition so long as pressure relief element 680 has not been ruptured fluid is not allowed to flow through flow tube 672. Alternatively, if the pressure has exceed a predetermined threshold, pressure relief element 680 will allow some fluid to flow toward the formation down through reverse out valve 600 via fluid passageway 670 and flow tube 672. It is noted, however, the cross sectional area of flow tube 672 is relatively small and the length of flow tube 672 is relatively long, such that only a minimal amount of fluid is allowed to flow toward the formation.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A reverse out valve comprising:

an outer housing;

a mandrel slidably disposed within the outer housing and forming a bypass region therebetween, the mandrel having a central flow path with a valve seat positioned therein and first and second side wall ports positioned on opposite sides of the valve seat; and a valve element positioned in the central flow path, the valve element and the valve seat having a one way valve configuration wherein fluid flow in a first direction relative to the central flow path is substantially prevented, the valve element being axially moveable relative to the valve seat to allow fluid flow in a second direction relative to the central flow path;

wherein the mandrel is axially movable relative to the outer housing between first and second positions, in the first position, a bypass passageway is formed between the first and second side wall ports via the bypass region thereby allowing bypass flow around the valve element and the valve seat and, in the second position, bypass flow is prevented; and wherein the outer housing includes an indicating collet that allows a predetermined force in the first direction to operate the mandrel from the first position to the second position and wherein the indicating collet allows a predetermined force in the second direction to operate the mandrel from the second position to the first position.

2. The reverse out valve as recited in claim 1 wherein the outer housing further comprises a positioning collet that selectively prevents axially movable of the mandrel relative to the outer housing.

3. The reverse out valve as recited in claim 1 wherein the valve element and the valve seat have a valve open configuration wherein a spring urges the valve element in the first direction.

4. The reverse out valve as recited in claim 1 wherein, in the one way valve configuration, a spring urges the valve element in the first direction.

5. The reverse out valve as recited in claim 1 further comprising a flow tube positioned in the central flow path and in fluid communication with a fluid passageway through the valve element.

6. The reverse out valve as recited in claim 5 wherein, in the one way valve configuration, fluid flow is allowed in the first direction and the second through the flow tube.

7. The reverse out valve as recited in claim 5 further comprising a pressure relief element disposed within the flow tube that selectively prevents fluid flow through the flow tube.

8. A method of operating a reverse out valve to minimize swabbing of a formation, the method comprising:

providing at least two independent flow paths for fluid flow in a first direction and at least two independent flow paths for fluid flow in a second direction through a reverse out valve in a run in configuration of the reverse out valve;

providing at least two independent flow paths for fluid flow in the first direction and at least three independent flow paths for fluid flow in the second direction through the reverse out valve in a circulating configuration of the reverse out valve; and providing at least one flow path for fluid flow in the second direction through the reverse out valve in a reverse configuration of the reverse out valve.

9. A method as recited in claim 8 further comprising providing at least two independent flow paths for fluid flow in the second direction through the reverse out valve in the reverse configuration of the reverse out valve.

10. A method as recited in claim 8 further comprising providing at least one flow path for fluid flow in the first direction through the reverse out valve in the reverse configuration of the reverse out valve.

11. A method of operating a reverse out valve to minimize swabbing of a formation, the method comprising:

running a reverse out valve downhole in a run in configuration while providing at least two independent flow paths for fluid flow in an uphole direction through the reverse out valve;

pumping a first fluid into an annulus around the reverse out valve with the reverse out valve in a circulating configuration while providing at least three independent flow paths for taking returns in the uphole direction through the reverse out valve;

retrieving the reverse out valve partially uphole while providing at least two independent flow paths for fluid flow in a downhole direction through the reverse out valve in the circulating configuration;

retrieving the reverse out valve farther uphole to operate the reverse out valve from the circulating configuration to a reverse configuration; and pumping a second fluid into the annulus around the reverse out valve while providing no more than one flow path for fluid flow in the downhole direction through the reverse out valve.

12. A reverse out valve comprising:

an outer housing;

a mandrel slidably disposed within the outer housing and forming a bypass region therebetween, the mandrel having a central flow path with a valve seat positioned therein and first and second side wall ports positioned on opposite sides of the valve seat;

a valve element positioned in the central flow path and operably associated with the valve seat to control fluid flow therebetween, the valve element having a fluid passageway; and a flow tube positioned in the central flow path and in fluid communication with the fluid passageway of the valve element;

wherein the first and second side wall ports and the bypass region form a first fluid path through the reverse out valve, wherein the valve element and the valve seat form a second fluid path through the reverse out valve, wherein the flow tube and the fluid passageway form a third fluid path through the reverse out valve and wherein the first, second and third fluid paths are independent of one another.

13. The reverse out valve as recited in claim 12 wherein the first fluid path is closed responsive to a predetermined force being applied in a first direction to an indicating collet of the outer housing and wherein the first fluid path is opened responsive to a predetermined force being applied in a second direction to the indicating collet.

14. The reverse out valve as recited in claim 12 wherein the second fluid path is opened responsive to relative axial movement of the mandrel and the outer housing.

15. The reverse out valve as recited in claim 12 wherein the second fluid path is opened responsive to a differential pressure and wherein the second fluid path is closed responsive to a spring urging the valve element.

16. The reverse out valve as recited in claim 12 wherein the third fluid path is closed responsive to a differential pressure.

17. The reverse out valve as recited in claim 12 wherein the third fluid path is always open.

18. The reverse out valve as recited in claim 12 wherein the third fluid path is selectively closed via a pressure relief element until the differential pressure thereacross exceeds a predetermined threshold.

19. A reverse out valve comprising:

an outer housing; and a mandrel slidably disposed within the outer housing, the mandrel and the outer housing having a circulating configuration and a reverse configuration relative to one another, in the circulating configuration, the reverse out valve having two independent flow paths for fluid flow in a first direction and three independent flow paths for fluid flow in a second direction, in the reverse configuration, the reverse out valve having one flow path for fluid flow in the first direction and two independent flow paths for fluid flow in the second direction.

20. A reverse out valve comprising:

an outer housing;

a mandrel slidably disposed within the outer housing and forming a bypass region therebetween, the mandrel having a central flow path with a valve seat positioned therein and first and second side wall ports positioned on opposite sides of the valve seat; and a valve element positioned in the central flow path, the valve element and the valve seat having a one way valve configuration wherein fluid flow in a first direction relative to the central flow path is substantially prevented, the valve element being axially moveable relative to the valve seat to allow fluid flow in a second direction relative to the central flow path;

wherein the mandrel is axially movable relative to the outer housing between first and second positions, in the first position, a bypass passageway is formed between the first and second side wall ports via the bypass region thereby allowing bypass flow around the valve element and the valve seat and, in the second position, bypass flow is prevented; and wherein the outer housing includes a positioning collet that selectively prevents axially movable of the mandrel relative to the outer housing.

21. The reverse out valve as recited in claim 20 wherein a spring urges the valve element in the first direction.

22. The reverse out valve as recited in claim 20 further comprising a flow tube positioned in the central flow path and in fluid communication with a fluid passageway through the valve element.

23. The reverse out valve as recited in claim 22 wherein, in the one way valve configuration, fluid flow is allowed in the first direction and the second through the flow tube.

24. The reverse out valve as recited in claim 22 further comprising a pressure relief element disposed within the flow tube that selectively prevents fluid flow through the flow tube.

25. A reverse out valve comprising:

an outer housing;

a mandrel slidably disposed within the outer housing and forming a bypass region therebetween, the mandrel having a central flow path with a valve seat positioned therein and first and second side wall ports positioned on opposite sides of the valve seat;

a valve element positioned in the central flow path, the valve element and the valve seat having a one way valve configuration wherein fluid flow in a first direction relative to the central flow path is substantially prevented, the valve element being axially moveable relative to the valve seat to allow fluid flow in a second direction relative to the central flow path; and a spring operably associated with the valve element, the spring urging the valve element in the first direction;

wherein the mandrel is axially movable relative to the outer housing between first and second positions, in the first position, a bypass passageway is formed between the first and second side wall ports via the bypass region thereby allowing bypass flow around the valve element and the valve seat and, in the second position, bypass flow is prevented.

26. The reverse out valve as recited in claim 25 wherein the outer housing further comprises an indicating collet that allows a predetermined force in the first direction to operate the mandrel from the first position to the second position and wherein the indicating collet allows a predetermined force in the second direction to operate the mandrel from the second position to the first position.

27. The reverse out valve as recited in claim 25 further comprising a flow tube positioned in the central flow path and in fluid communication with a fluid passageway through the valve element.

28. The reverse out valve as recited in claim 27 wherein, in the one way valve configuration, fluid flow is allowed in the first direction and the second through the flow tube.

29. The reverse out valve as recited in claim 27 further comprising a pressure relief element disposed within the flow tube that selectively prevents fluid flow through the flow tube.

30. A reverse out valve comprising:

an outer housing;

a mandrel slidably disposed within the outer housing and forming a bypass region therebetween, the mandrel having a central flow path with a valve seat positioned therein and first and second side wall ports positioned on opposite sides of the valve seat;

a valve element positioned in the central flow path, the valve element and the valve seat having a one way valve configuration wherein fluid flow in a first direction relative to the central flow path is substantially prevented, the valve element being axially moveable relative to the valve seat to allow fluid flow in a second direction relative to the central flow path; and a flow tube positioned in the central flow path and in fluid communication with a fluid passageway through the valve element;

wherein the mandrel is axially movable relative to the outer housing between first and second positions, in the first position, a bypass passageway is formed between the first and second side wall ports via the bypass region thereby allowing bypass flow around the valve element and the valve seat and, in the second position, bypass flow is prevented.

31. The reverse out valve as recited in claim 30 wherein, in the one way valve configuration, fluid flow is allowed in the first direction and the second through the flow tube.

32. The reverse out valve as recited in claim 30 further comprising a pressure relief element disposed within the flow tube that selectively prevents fluid flow through the flow tube.

* * * * *